US009919830B2

(12) United States Patent
Smith et al.

(10) Patent No.: US 9,919,830 B2
(45) Date of Patent: Mar. 20, 2018

(54) CONTAINER WITH A REINFORCEMENT STRUCTURE AND METHOD OF FORMING THE SAME

(71) Applicant: WestRock Shared Services, LLC, Norcross, GA (US)

(72) Inventors: Kenneth Charles Smith, Hiram, GA (US); Jeffrey Scott James, Elmhurst, IL (US); Timothy McCarthy, Chicago, IL (US)

(73) Assignee: WestRock Shared Services, LLC, Norcross, GA (US)

( * ) Notice: Subject to any disclaimer, the term of this patent is extended or adjusted under 35 U.S.C. 154(b) by 168 days.

(21) Appl. No.: 14/755,280

(22) Filed: Jun. 30, 2015

(65) Prior Publication Data

US 2017/0001750 A1 Jan. 5, 2017

(51) Int. Cl.

| | |
|---|---|
| ***B65D 5/44*** | (2006.01) |
| ***B65D 5/02*** | (2006.01) |
| ***B65D 5/42*** | (2006.01) |
| *B65D 5/4805* | (2006.01) |

(52) U.S. Cl.

CPC ..... *B65D 5/443* (2013.01); *B65D 5/0227* (2013.01); *B65D 5/4266* (2013.01)

(58) Field of Classification Search

None

See application file for complete search history.

(56) References Cited

U.S. PATENT DOCUMENTS

| | | | | |
|---|---|---|---|---|
| RE2,655 E | | 6/1867 | Gibbs | |
| 1,425,549 A | | 8/1922 | Scruby | |
| 2,920,757 A | | 1/1960 | Garman | |
| 3,260,440 A | | 7/1966 | Foley | |
| 3,348,667 A | | 10/1967 | Beeby | |
| 3,367,558 A | * | 2/1968 | Farquhar | B65D 5/0227 229/134 |
| 3,653,495 A | | 4/1972 | Gray | |
| 3,836,065 A | | 9/1974 | Hackenberg | |
| 3,985,286 A | | 10/1976 | Hicks | |
| 4,030,600 A | | 6/1977 | Heaps | |
| 4,058,206 A | | 11/1977 | Morse et al. | |
| 4,081,124 A | | 3/1978 | Hall | |

(Continued)

FOREIGN PATENT DOCUMENTS

GB 428564 A * 5/1935 ..... B65D 5/443

OTHER PUBLICATIONS

International Search Report and Written Opinion for PCT/US15/01142, dated Nov. 30, 2015.

(Continued)

*Primary Examiner* — Nathan J Newhouse

(74) *Attorney, Agent, or Firm* — WestRock IP Legal

(57) ABSTRACT

A blank of sheet material for forming a container is provided. The blank of sheet material includes at least one major bottom panel, two opposing side panels, and two opposing end panels. Each end panel includes a plurality of fold lines that define two opposing side edges, a first minor end panel, a second minor end panel, and at least two reinforcement panels positioned between the two side edges. The at least two reinforcement panels are configured to move inwardly towards an interior cavity of the container forming a reinforcement structure when the container is formed.

26 Claims, 31 Drawing Sheets

(56) References Cited

U.S. PATENT DOCUMENTS

| | | | | |
|---|---|---|---|---|
| 4,105,154 | A | 8/1978 | Meyers et al. | |
| 4,197,979 | A | 4/1980 | Dutcher | |
| 4,220,076 | A | 9/1980 | Moen | |
| 4,282,999 | A | 8/1981 | Moen | |
| 4,310,323 | A | 1/1982 | Moen | |
| 4,315,752 | A | 2/1982 | Moen | |
| 4,427,108 | A | 1/1984 | Coles et al. | |
| 4,512,511 | A | 4/1985 | Zimmermann | |
| 4,519,538 | A | 5/1985 | Omichi | |
| 4,607,750 | A | 8/1986 | Valenti | |
| 4,676,429 | A | 6/1987 | Crowe et al. | |
| 4,779,737 | A | 10/1988 | Umehara et al. | |
| 4,793,494 | A | 12/1988 | Gordon, Jr. | |
| 4,817,803 | A * | 4/1989 | Risucci | B65D 5/5495 229/101.2 |
| 4,826,016 | A | 5/1989 | Foster | |
| 4,871,067 | A | 10/1989 | Valenti | |
| 4,948,033 | A | 8/1990 | Halsell, II et al. | |
| 4,974,773 | A | 12/1990 | Alexander et al. | |
| 5,139,196 | A | 8/1992 | Fry et al. | |
| 5,147,271 | A * | 9/1992 | Bacques | B31B 1/28 493/143 |
| 5,316,210 | A | 5/1994 | Scullin | |
| 5,330,094 | A * | 7/1994 | Mertz | B65D 5/0045 229/167 |
| 5,372,299 | A | 12/1994 | Edgerton et al. | |
| 5,464,149 | A | 11/1995 | Fowler et al. | |
| 5,520,325 | A | 5/1996 | Quaintance | |
| 5,657,925 | A | 8/1997 | Norris | |
| 5,697,548 | A | 12/1997 | Halsell | |
| 5,758,818 | A | 6/1998 | Ewing | |
| 5,950,911 | A | 9/1999 | Naughton et al. | |
| 5,950,915 | A | 9/1999 | Moen | |
| 5,967,406 | A | 10/1999 | Moorman | |
| 6,270,007 | B1 | 8/2001 | Jensen | |
| 6,311,891 | B1 | 11/2001 | Gardner | |
| 6,488,200 | B1 | 12/2002 | Jensen | |
| 6,499,655 | B1 | 12/2002 | Moen | |
| 6,520,898 | B1 | 2/2003 | Moen | |
| 6,669,081 | B2 | 12/2003 | Hearne et al. | |
| 6,676,012 | B1 * | 1/2004 | Southwell | B65D 5/002 229/120.17 |
| 6,974,033 | B2 | 12/2005 | McLeod et al. | |
| 7,000,773 | B2 | 2/2006 | Hubbs et al. | |
| 7,066,379 | B2 | 6/2006 | McLeod et al. | |
| 7,320,407 | B2 | 1/2008 | Hubbs et al. | |
| 7,455,215 | B2 | 11/2008 | McLeod et al. | |
| 7,819,305 | B2 | 10/2010 | Little | |
| 7,861,916 | B2 | 1/2011 | Little | |
| 7,922,069 | B2 | 4/2011 | Gardner | |
| 8,292,082 | B2 | 10/2012 | Bowman | |
| 8,474,686 | B2 | 7/2013 | Glaser | |
| 8,485,420 | B2 | 7/2013 | Barner | |
| 8,777,093 | B2 | 7/2014 | Smith | |
| 8,800,854 | B2 | 8/2014 | Chapman et al. | |
| 2005/0116017 | A1 * | 6/2005 | Nass | B65D 5/0045 229/143 |
| 2008/0265010 | A1 | 10/2008 | Montague | |
| 2008/0314794 | A1 | 12/2008 | Bowman | |
| 2009/0223857 | A1 | 9/2009 | Bowman | |
| 2011/0011922 | A1 | 1/2011 | Little | |
| 2014/0305999 | A1 | 10/2014 | Smith | |

OTHER PUBLICATIONS

PCT Foreign Search Report and Written Opinion for related application PCT/US2015/46234 dated Nov. 30, 2015; 11 pp.

* cited by examiner

CONTAINER WITH A REINFORCEMENT STRUCTURE AND METHOD OF FORMING THE SAME

BACKGROUND

The field of the present disclosure relates generally to packaging containers and, more particularly, to a one-piece container having a reinforcement structure that provides additional stacking strength to the container.

At least some known containers that are used to transport and/or store products may be stacked on top of each other when the products are being transported or stored. The side walls of the containers on the lower layers of the stack are configured to support a weight of the containers on the upper layers of the stack. However, if the weight on a lower container causes the side walls of the lower container to bulge outwardly or inwardly, a bottom wall of an upper container can settle into, or "nest" within, a cavity defined by the sidewalls of the lower container. Products within the lower container may then be required to support the weight of the upper layers. Alternatively, the stacked containers may completely collapse or fall over when the side walls of the lower stacked containers bulge. In either case, the products within the containers may be damaged during transport and/or storage.

BRIEF DESCRIPTION

In one aspect, a blank of sheet material for forming a container is provided. The blank of sheet material includes at least one major bottom panel, two opposing side panels, and two opposing end panels. Each end panel includes a plurality of fold lines that define two opposing side edges, a first minor end panel, a second minor end panel, and at least two reinforcement panels positioned between the two side edges. The at least two reinforcement panels are configured to move inwardly towards an interior cavity of the container forming a reinforcement structure when the container is formed.

In another aspect, a container formed from a blank of sheet material is provided. The container includes two side walls, two end walls, and a bottom wall. Each end wall includes a plurality of fold lines that define two opposing side edges, a first minor end panel, a second minor end panel, and at least two reinforcement panels positioned between the two side edges. The two end walls are folded along the plurality of fold lines such that the at least two reinforcement panels move inwardly towards an interior cavity of the container forming a reinforcement structure.

In yet another aspect, a method of forming a container from a blank of sheet material is provided. The blank of sheet material includes at least one major bottom panel, two side panels, two end panels, and two minor bottom flaps. Each end panel includes a plurality of fold lines that define two opposing side edges, a first minor end panel, a second minor end panel, and at least two reinforcement panels positioned between the two side edges. The method includes folding the two end panels along the plurality of fold lines such that the at least two reinforcement panels move inwardly towards an interior cavity of the container forming a reinforcement structure, and such that at least a portion of each minor bottom flap overlap with each other forming a minor bottom flap assembly. The method also includes rotating inwardly the minor bottom flap assembly until the minor bottom flap assembly is substantially perpendicular to the two end panels, and rotating inwardly the at least one major bottom panel to couple the at least one major bottom panel to the minor bottom flap assembly forming a bottom wall of the container, and to couple the bottom wall of the container to the reinforcement structure.

DETAILED DESCRIPTION

Figure 1:
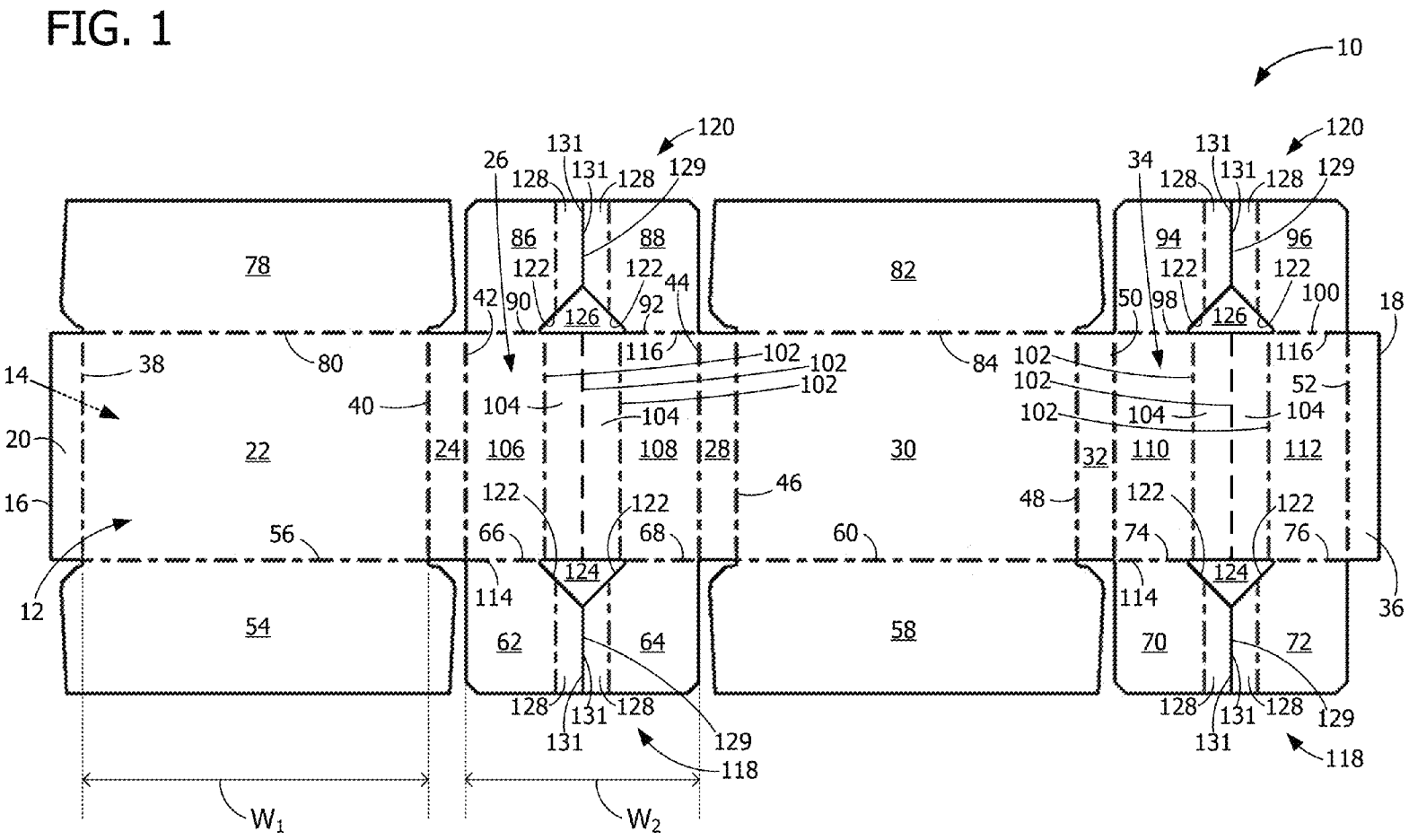
FIG. 1 is a top plan view of a first blank of sheet material for forming a container in accordance with one embodiment of the disclosure.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

A container and a blank for constructing the same are described herein. More specifically, a container, that includes a reinforcement structure, and methods for forming the same are described herein. As described herein, the reinforcing container may include multiple embodiments. However, each embodiment includes a reinforcement structure on each end wall that projects inwardly into the container. The resulting container provides substantially more stacking strength while using a similar amount of sheet material as compared to other known containers. It will also be apparent to those skilled in the art and guided by the teachings herein provided that the invention is likewise applicable to any storage container including, without limitation, a carton, a tray, a box, or a bin.

In one embodiment, the container is fabricated from at least one of a corrugated board and paperboard material. The container, however, may be fabricated using any suitable material, and therefore is not limited to a specific type of material. In alternative embodiments, the container is fabricated using cardboard, plastic, and/or any suitable material known to those skilled in the art and guided by the teachings herein provided.

Embodiments of the present disclosure provide a container formed from a single sheet of blank material and having improved stacking strength when compared to conventional four-sided or eight-sided boxes. More specifically, the container includes a reinforcement structure that extends inwardly from an end panel towards an interior of the container. The reinforcement structure is formed from at least two reinforcement panels, which are defined along one of the end panels by a plurality of fold lines. As such, the reinforcement structure provides additional compression strength to the container, which (i) reduces the likelihood of stacked containers from nesting within each other, (ii) reduces the need for slip sheets between each container layer of a full pallet load, and (iii) reduces the need for different corrugated or paperboard inserts within the container. Moreover, the one-piece design enables the container to be formed automatically or semi-automatically with a machine, such as a container forming machine having a mandrel that is configured to wrap the blank around the mandrel and form the container.

In one embodiment, the container and/or a blank includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product, and/or a seller of the product. Furthermore, the container may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arranging a plurality of containers.

Referring now to the drawings, FIG. 1 is a top plan (external) view of a first blank 10 of sheet material for forming a container in accordance with one embodiment of the disclosure. In the example embodiment, first blank 10 has a first or exterior surface 12, and an opposing second or interior surface 14. Further, first blank 10 defines a leading edge 16 and an opposing trailing edge 18. Moreover, first blank 10 includes, from leading edge 16 to trailing edge 18, a glue joint panel 20, a first side panel 22, a first corner panel 24, a first end panel 26, a second corner panel 28, a second side panel 30, a third corner panel 32, a second end panel 34, and a joining tab 36 coupled together along preformed, generally parallel fold lines 38, 40, 42, 44, 46, 48, 50, and 52, respectively. Side panels 22 and 30 have a first width $W_1$, and end panels 26 and 34 have a second width $W_2$ less than first width $W_1$. However, it should be understood that the plurality of side panels can each have any suitable size, shape, and/or configuration that enables blank 10 and/or the container portion to function as described herein. Additionally, although glue joint panel 20, side panels 22 and 30, end panels 26 and 34, and corner panels 24, 28, and 32 are specifically referred to herein, it should be noted that glue joint panel 20, side panels 22 and 30, end panels 26 and 34, and corner panels 24, 28, and 32 can collectively be referred to as side panels or side walls.

First side panel 22 extends from glue joint panel 20 along fold line 38, first corner panel 24 extends from first side panel 22 along fold line 40, first end panel 26 extends from first corner panel 24 along fold line 42, second corner panel 28 extends from first end panel 26 along fold line 44, second side panel 30 extends from first end panel 26 along fold line 46, third corner panel 32 extends from second side panel 30 along fold line 48, second end panel 34 extends from third corner panel 32 along fold line 50, and joining tab 36 extends from second end panel 34 along fold line 52. Fold lines 38, 40, 42, 44, 46, 48, 50, and 52 as well as other fold lines and/or hinge lines described herein, may include any suitable line of weakness and/or line of separation known to those skilled in the art and guided by the teachings herein provided.

First blank 10 includes a plurality of bottom panels and/or bottom flaps for forming a bottom wall of the container. For example, first side panel 22 includes a first major bottom panel 54 extending therefrom along a fold line 56, second side panel 30 includes a second major bottom panel 58 extending therefrom along a fold line 60, first end panel 26 includes a first minor bottom flap 62 and a second minor bottom flap 64 extending therefrom along fold lines 66 and 68, and second end panel 34 includes a third minor bottom flap 70 and a fourth minor bottom flap 72 extending therefrom along fold lines 74 and 76.

First blank 10 also includes a plurality of top panels and/or top flaps for forming a top wall of the container. For example, first side panel 22 includes a first major top panel 78 extending therefrom along a fold line 80, second side panel 30 includes a second major top panel 82 extending therefrom along a fold line 84, first end panel 26 includes a first minor top flap 86 and a second minor top flap 88 extending therefrom along fold lines 90 and 92, and second end panel 34 includes a third minor top flap 94 and a fourth minor top flap 96 extending therefrom along fold lines 98 and 100.

In the example embodiment, first and second end panels 26 and 34 include a plurality of fold lines 102 that define at least two minor end panels and at least two reinforcement panels 104 for each end panel 26 and 34. More specifically, fold lines 102 define a first minor end panel 106 and a second minor end panel 108 along first end panel 26, and fold lines 102 define a third minor end panel 110 and a fourth minor end panel 112 along second end panel 34. As such, each minor bottom flap extends from a bottom edge 114 of each end panel 26 and 34. More specifically, first minor bottom flap 62 extends from first minor end panel 106 along fold line 66, second minor bottom flap 64 extends from second minor end panel 108 along fold line 68, third minor bottom flap 70 extends from third minor end panel 110 along fold line 74, and fourth minor bottom flap 72 extends from fourth minor end panel 112 along fold line 76. Further, each minor top flap extends from a top edge 116 of each end panel 26 and 34. More specifically, first minor top flap 86 extends from first minor end panel 106 along fold line 90, second minor top flap 88 extends from second minor end panel 108 along fold line 92, third minor top flap 94 extends from third minor end panel 110 along fold line 98, and fourth minor top flap 96 extends from fourth minor end panel 112 along fold line 100.

In one embodiment, adjacent minor bottom flaps 62, 64, 70, and 72 and adjacent minor top flaps 86 and 88, and 94 and 96 form minor flap assemblies. More specifically, minor bottom flaps 62 and 64, and 70 and 72 form minor bottom flap assemblies 118, and minor top flaps 86 and 88, and 94 and 96 form minor top flap assemblies 120. Minor bottom flaps 62, 64, 70, and 72 each include an angled edge portion 122 extending from bottom edge 114 of each end panel 26 or 34. Moreover, minor top flaps 86, 88, 94, and 96 each include an angled edge portion 122 extending from top edge 116 of each end panel 26 or 34. Angled edge portions 122 of adjacent minor bottom flaps 62, 64, 70, and 72 substantially align to form a bottom notch 124 in minor bottom flap assemblies 118, and angled edge portions 122 of adjacent minor top flaps 86, 88, 94, and 96 substantially align to form a top notch 126 in minor top flap assemblies 120. Bottom and top notches 124 and 126 are sized to receive a reinforcement structure formed from reinforcement panels 104.

Figure 2:
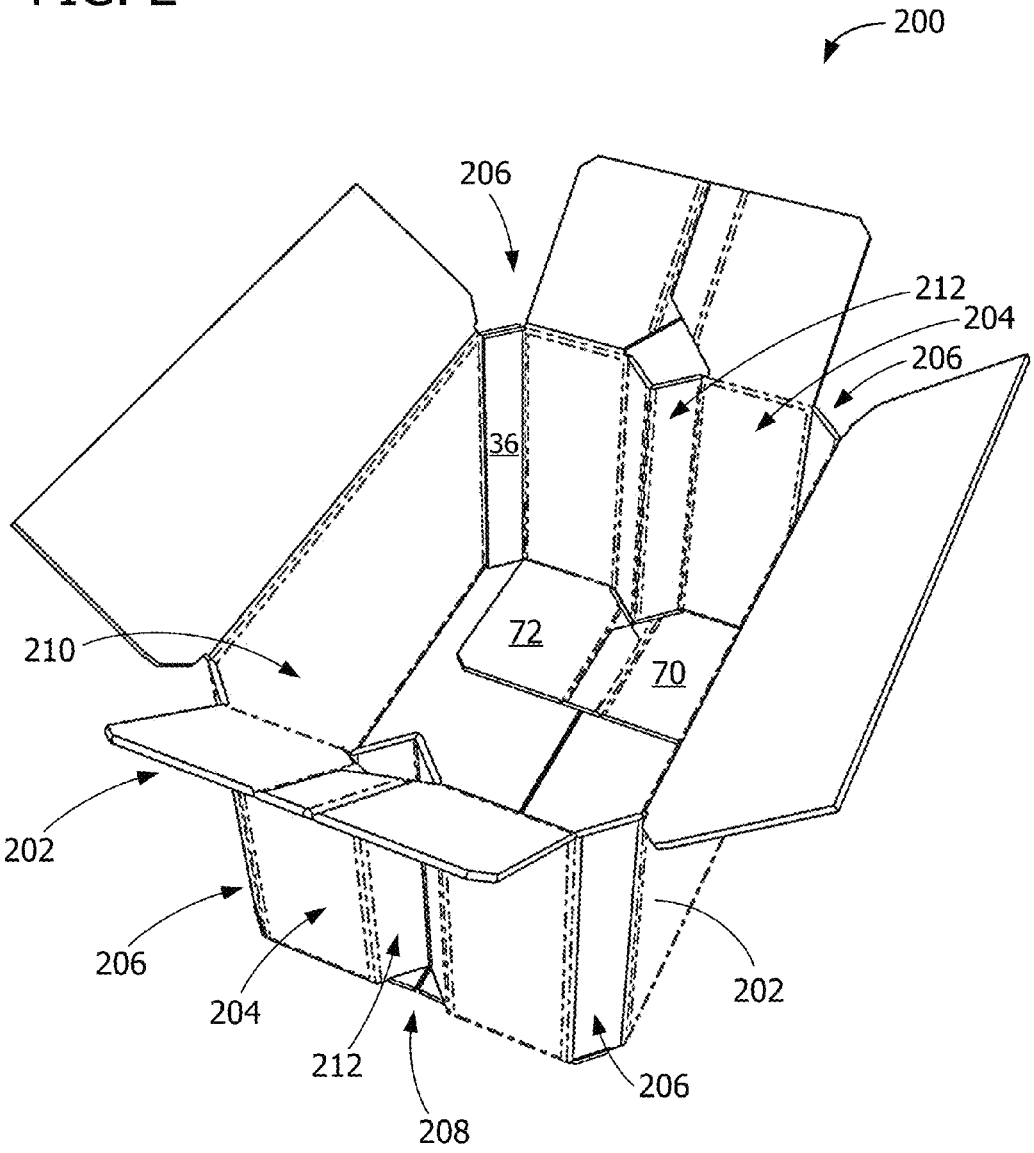
FIG. 2 is a perspective view of the container formed from the first blank of sheet material.

Moreover, at least a portion 128 of minor bottom flaps 62, 64, 70, and 72 and minor top flaps 86, 88, 94, and 96 are oriented to overlap with each other when blank 10 is formed into container 200 (shown in FIG. 2). More specifically, when the end walls of container 200 are formed, reinforcement panels 104 are rotated inwardly about fold lines 102. This results in minor bottom flaps 62, 64, 70, and 72 and minor top flaps 86, 88, 94, and 96 moving relative to each other such that the flaps at least partially overlap with each other and, in one embodiment, are glued together. More specifically, a cut line 129 is defined between adjacent minor bottom flaps 62, 64, 70, and 72 and adjacent minor top flaps 86 and 88, and 94 and 96. Cut lines 129 define free edges 131 of adjacent minor bottom flaps 62, 64, 70, and 72 and adjacent minor top flaps 86 and 88, and 94 and 96. As such, cut lines 129 enable free edges 131 to crossover each other when forming the end walls of container 200. Further, portions 128 of adjacent minor flaps are positioned adjacent to each other, and at least partially define bottom and top notches 124 and 126.

Figure 3:
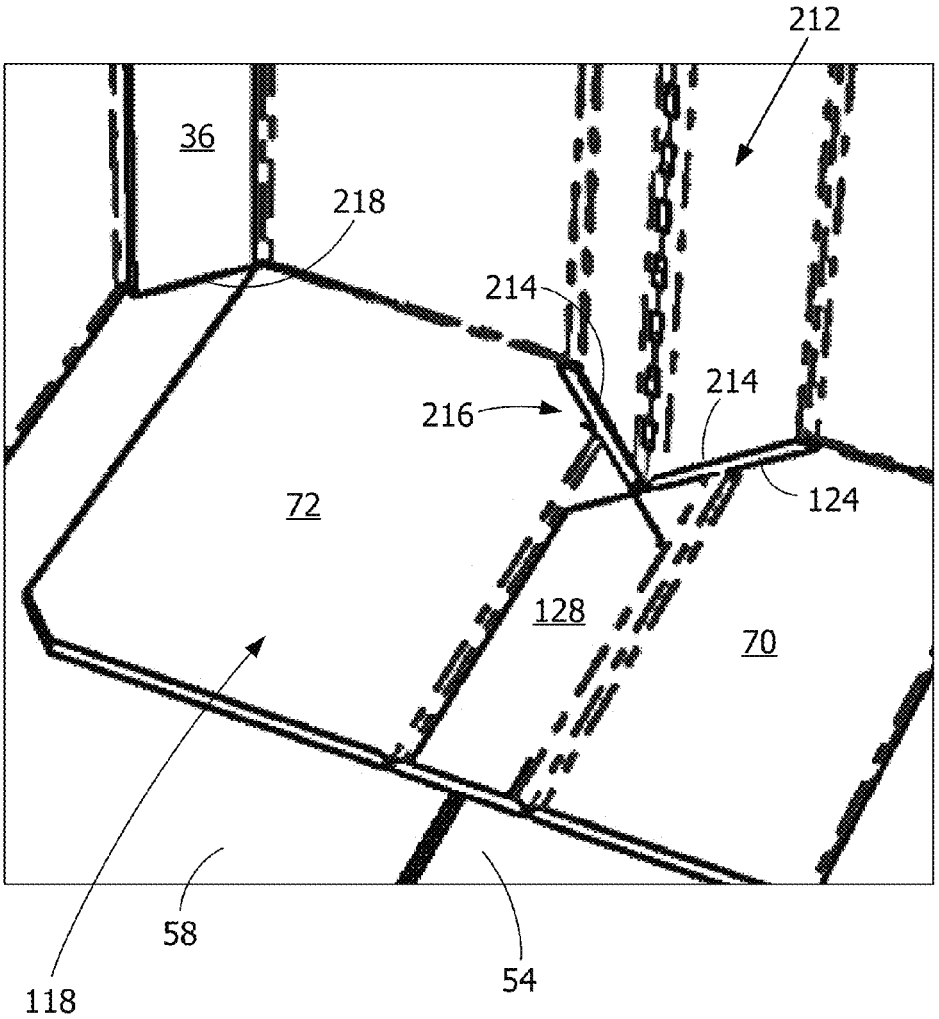
FIG. 3 is an enlarged perspective view of a portion of the container shown in FIG. 2.

FIG. 2 is a perspective view of a container 200 formed from first blank 10 of sheet material, and FIG. 3 is an enlarged perspective view of a portion of container 200 (shown in FIG. 2). In the example embodiment, container 200 includes two side walls 202, two end walls 204, corner walls 206, and a bottom wall 208. Each of walls 202, 204, 206, and 208 define an interior cavity 210 within container 200. Moreover, as will be described in more detail below, end panels 26 and 34 are foldable along fold lines 102 such that reinforcement panels 104 (each shown in FIG. 1) move inwardly towards interior cavity 210 of container 200 to form a reinforcement structure 212.

Container 200 is formed by folding first blank 10 along fold lines, perforation lines, and/or score lines. Specifically, end walls 204 are formed by folding end panels 26 and 34 along fold lines 102 such that reinforcement panels 104 move inwardly towards interior cavity 210 of container 200 forming reinforcement structure 212. In one embodiment, end panels 26 and 34 are folded along fold lines 102 such that reinforcement panels 104 are oriented at an oblique angle relative to each other. For example, the angle defined between reinforcement panels 104 is within a range between about 0 degrees and about 180 degrees. As such, end walls 204 have a width less than width $W_2$ of end panels 26 and 34. Moreover, end panels 26 and 34 are folded along fold lines 102 such that at least portions 128 of each minor bottom flap 62, 64, 70, and 72 overlap with each other forming minor bottom flap assemblies 118. Minor bottom flap assemblies 118 are then rotated inwardly along fold lines 66, 68, 74, and 76 until minor bottom flap assemblies 118 are substantially perpendicular to end panels 26 and 34.

Side walls 202 and corner walls 206 are formed by rotating glue joint panel 20, by rotating side panels 22 and 30, and by rotating corner panels 24, 28, and 32 about fold lines 38, 40, 42, 44, 46, 48, and 50. Joining tab 36 then rotates about fold line 52 to couple to glue joint panel 20. Bottom wall 208 is formed by rotating major bottom panels 54 and 58 inwardly to couple major bottom panels 54 and 58 to minor bottom flap assemblies 118. More specifically, interior surfaces 14 of major bottom flaps 54 and 58 couple to exterior surfaces 12 of at least one of minor bottom flaps 62, 64, 70, and 72.

Referring to FIG. 3, reinforcement panels 104 each include a bottom edge 214 that defines a reinforcement base 216 of reinforcement structure 212. Reinforcement base 216 and bottom notch 124 have a substantially similar profile, which facilitates coupling reinforcement base 216 to interior surface 14 (shown in FIG. 1) of bottom wall 208. More specifically, bottom notch 124 is sized to receive at least a portion of reinforcement structure 212, such that reinforcement base 216 extends through bottom notch 124 to couple to at least one of major bottom panels 54 and 58. Moreover, a bottom edge 218 of joining tab 36 also couples to at least one of major bottom panels 54 and 58. As described above, fold lines 102 are oriented such that reinforcement panels 104 extend between bottom edge 114 and top edge 116 of end panels 26 and 34. Likewise, glue joint panel 20 and corner panels 24, 28, and 32 extend between bottom edge 114 and top edge 116 of end panels 26 and 34. As such, coupling bottom edges 214 and 218 of reinforcement panels 104, joining tab 36, and corner panels 24, 28, and 32 to major bottom panels 54 and 58 facilitates ensuring a substantially uniform pressure distribution is formed across bottom wall 208 when additional containers are stacked on top of container 200.

Figure 4:
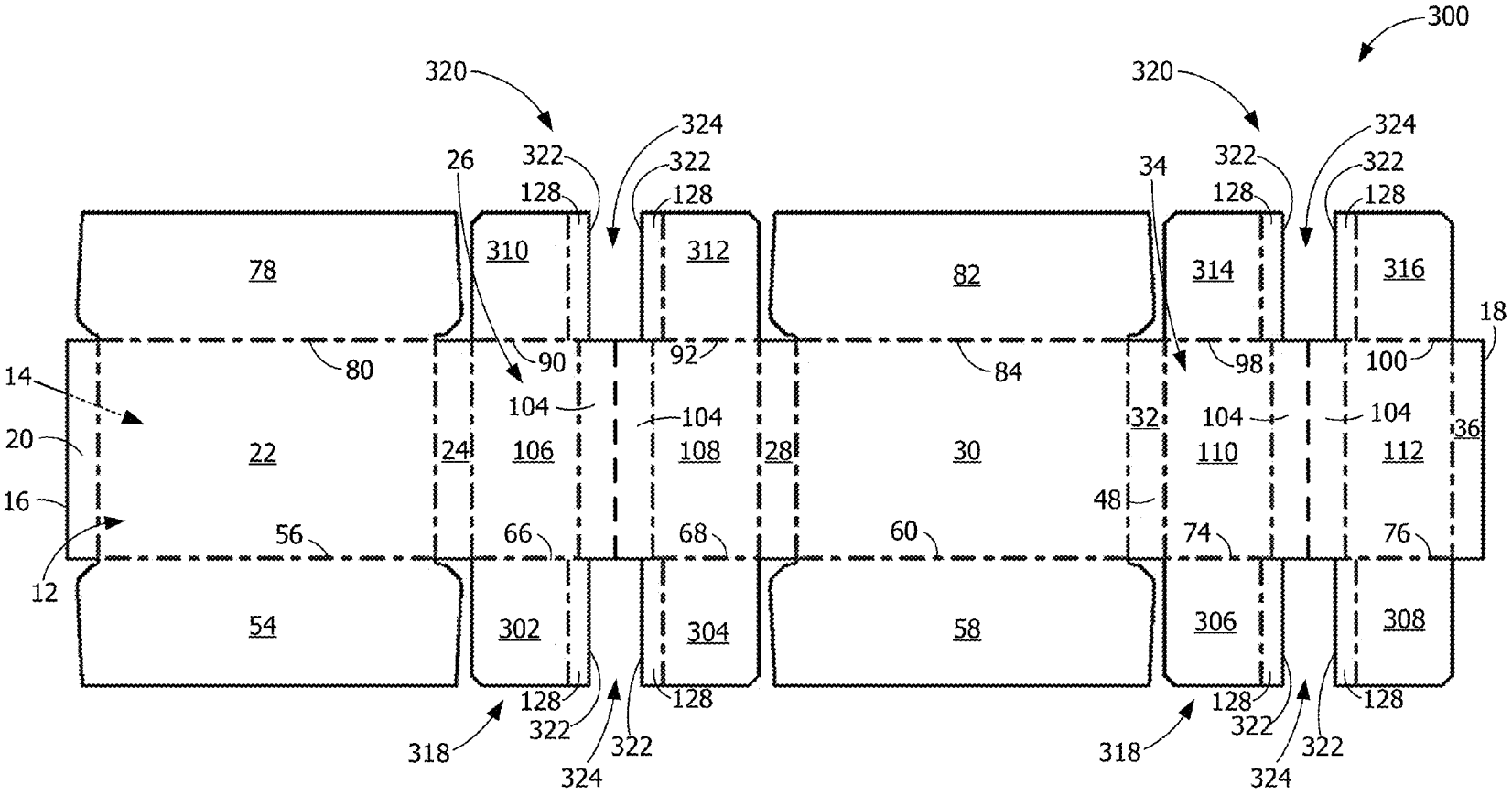
FIG. 4 is a top plan view of a second blank of sheet material for forming a container in accordance with another embodiment of the disclosure.
Figure 5:
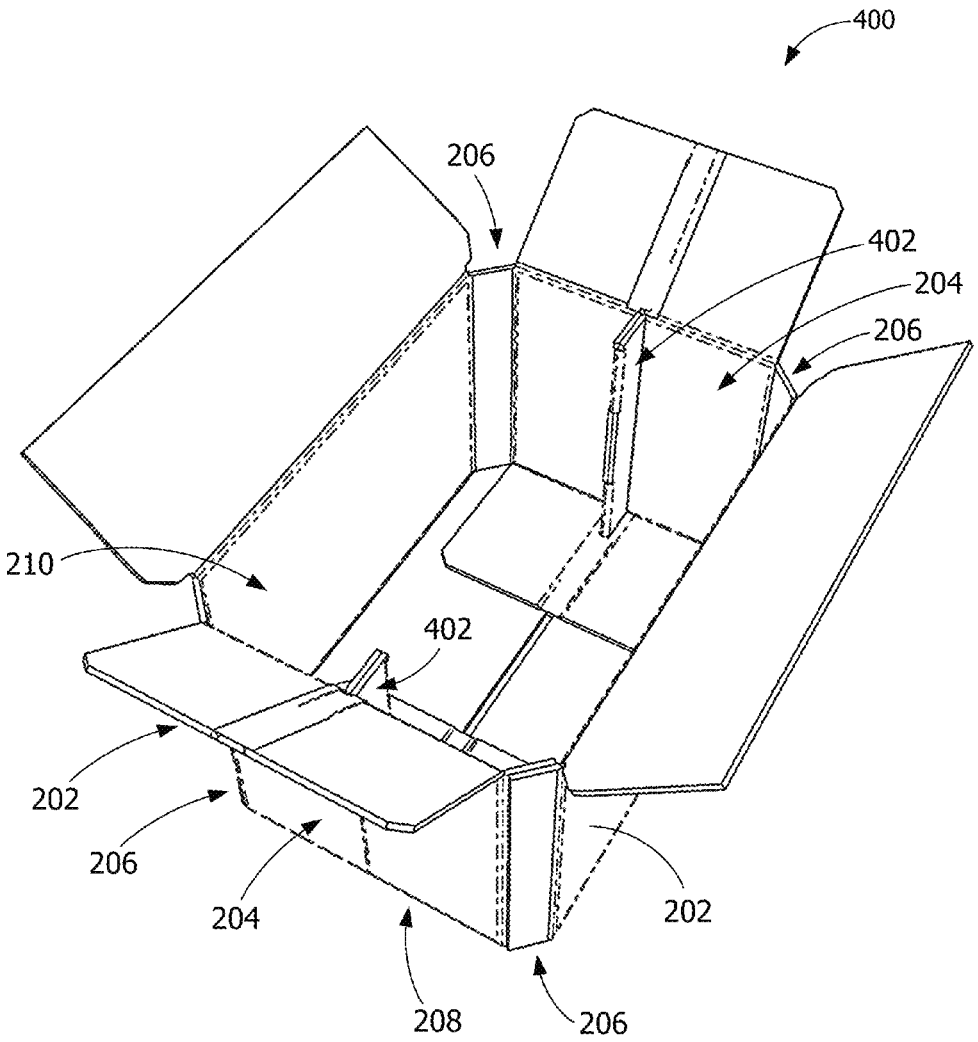
FIG. 5 is a perspective view of the container formed from the second blank of sheet material.
Figure 6:
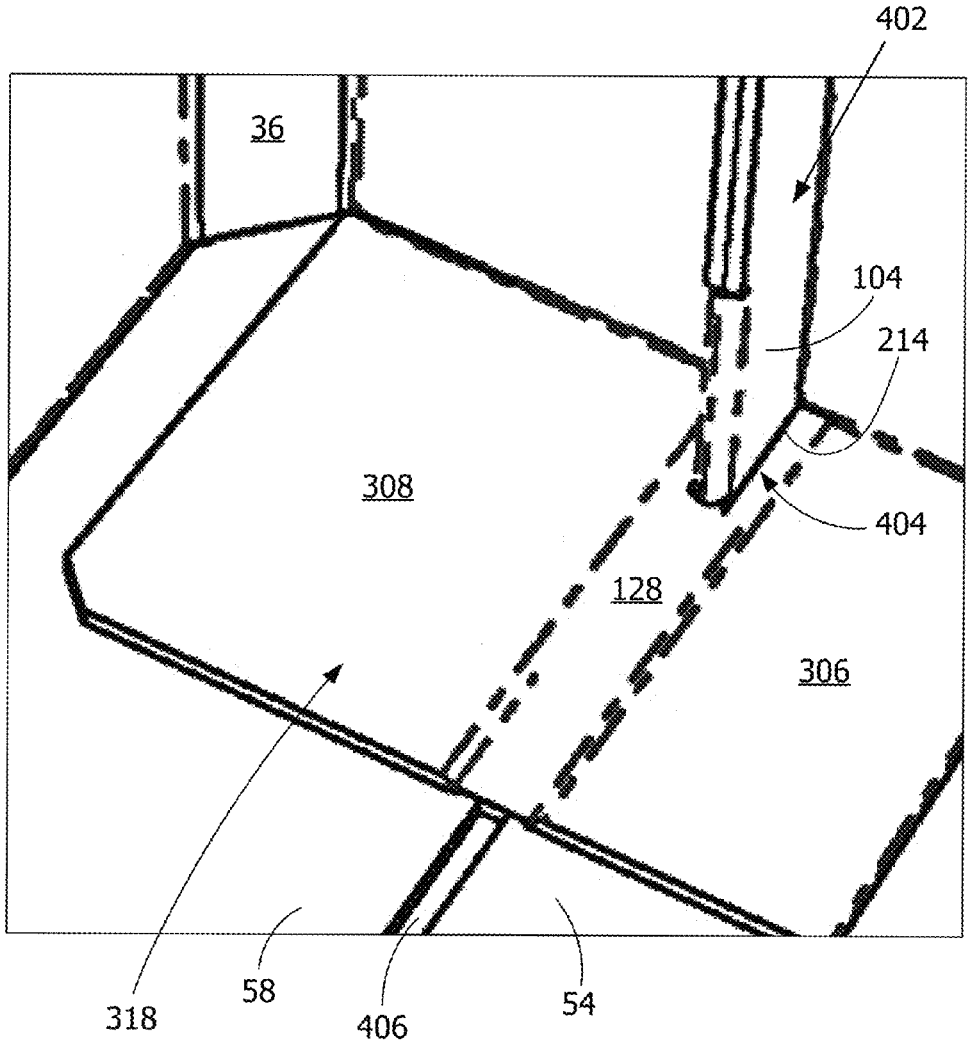
FIG. 6 is an enlarged perspective view of a portion of the container shown in FIG. 5.

FIG. 4 is a top plan view of a second blank 300 of sheet material for forming a container 400 in accordance with another embodiment of the disclosure, FIG. 5 is a perspective view of container 400 formed from second blank 300 of sheet material, and FIG. 6 is an enlarged perspective view of a portion of container 400. In the example embodiment, second blank 300 includes a plurality of bottom panels and/or bottom flaps for forming a bottom wall of container 400. For example, first side panel 22 includes first major bottom panel 54 extending therefrom along fold line 56, second side panel 30 includes second major bottom panel 58 extending therefrom along fold line 60, first end panel 26 includes a fifth minor bottom flap 302 and a sixth minor bottom flap 304 extending therefrom along fold lines 66 and 68, and second end panel 34 includes a seventh minor bottom flap 306 and an eighth minor bottom flap 308 extending therefrom along fold lines 74 and 76.

Second blank 300 also includes a plurality of top panels and/or top flaps for forming a top wall of container 400. For example, first side panel 22 includes first major top panel 78 extending therefrom along fold line 80, second side panel 30 includes second major top panel 82 extending therefrom along fold line 84, first end panel 26 includes a fifth minor top flap 310 and a sixth minor top flap 312 extending therefrom along fold lines 90 and 92, and second end panel 34 includes a seventh minor top flap 314 and an eighth minor top flap 316 extending therefrom along fold lines 98 and 100.

In one embodiment, adjacent minor bottom flaps 302, 304, 306, and 308 and adjacent minor top flaps 310, 312, 314, and 316 form minor flap assemblies. More specifically, minor bottom flaps 302 and 304, and 306 and 308 form minor bottom flap assemblies 318, and minor top flaps 310 and 312, and 314 and 316 form minor top flap assemblies 320. Minor bottom flaps 302, 304, 306, and 308 each include a straight edge portion 322 extending from bottom edge 114 of each end panel 26 or 34. Moreover, minor top flaps 310, 312, 314, and 316 each include straight edge portion 322 extending from top edge 116 of each end panel 26 or 34. Straight edge portions 322 of adjacent minor bottom flaps 302, 304, 306, and 308 and adjacent minor top flaps 310, 312, 314, and 316 are separated by a gap 324 having a length less than a width of reinforcement panels 104 in each end panel 26 and 34. As such, at least a portion 128 of minor bottom flaps 302, 304, 306, and 308 and minor top flaps 310, 312, 314, and 316 are oriented to overlap with each other when end panels 26 and 34 are folded along the plurality of fold lines 102. In one embodiment, portions 128 of adjacent minor bottom flaps are glued together to form container 400.

Referring to FIG. 5, container 400 is formed by folding second blank 300 along fold lines, perforation lines, and/or score lines. Specifically, end walls 204 are formed by folding end panels 26 and 34 along fold lines 102 such that reinforcement panels 104 move inwardly towards interior cavity 210 of container 400 forming a reinforcement structure 402. In one embodiment, end panels 26 and 34 are folded along fold lines 102 such that reinforcement panels 104 are oriented in face-to-face contact with each other and, in one embodiment, glued together to form reinforcement structure 402. As such, end walls 204 have a width less than width $W_2$ of end panels 26 and 34. Moreover, end panels 26 and 34 are folded along fold lines 102 such that at least portions 128 of each minor bottom flap 302, 304, 306, and 308 overlap with each other forming minor bottom flap assemblies 318. Minor bottom flap assemblies 318 are then rotated inwardly along fold lines 66, 68, 74, and 76 until minor bottom flap assemblies 318 are substantially perpendicular to end panels 26 and 34.

Side walls 202 and corner walls 206 are formed by rotating glue joint panel 20, by rotating side panels 22 and 30, and by rotating corner panels 24, 28, and 32 about fold lines 38, 40, 42, 44, 46, 48, and 50. Joining tab 36 then rotates about fold line 52 to couple to glue joint panel 20. Bottom wall 208 is formed by rotating major bottom panels 54 and 58 inwardly to couple major bottom panels 54 and 58 to minor bottom flap assemblies 318. More specifically, interior surfaces 14 (shown in FIG. 4) of major bottom flaps 54 and 58 couple to exterior surfaces 12 of at least one of minor bottom flaps 302, 304, 306, and 308.

Referring to FIG. 6, reinforcement panels 104 each include bottom edge 214 that defines a reinforcement base 404 of reinforcement structure 402. Reinforcement base 404 couples to interior surface 14 of at least one of minor bottom flaps 302, 304, 306, and 308 to provide additional compression strength to container 400. More specifically, in the example embodiment, portions 128 of minor bottom flaps 302, 304, 306, and 308 extend across a gap 406 formed in bottom wall 208 (shown in FIG. 5) defined between major bottom flaps 54 and 58. As such, extending portions 128 across gap 406 enables reinforcement base 404 to be coupled to minor bottom flaps 302, 304, 306, and 308, and facilitates ensuring a compressive load induced from additional containers stacked on top of container 400 is distributed to bottom wall 208.

Figure 7:
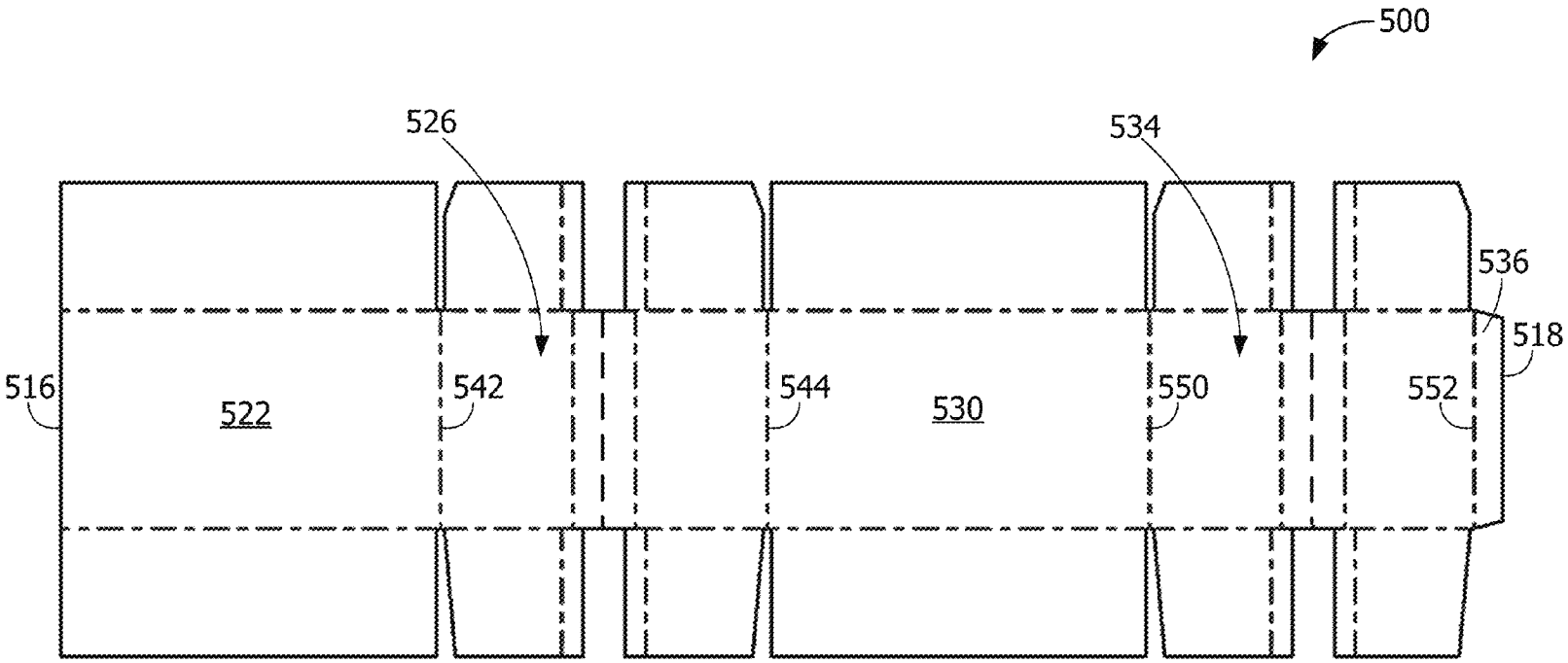
FIG. 7 is a top plan view of a third blank of sheet material for forming a container in accordance with another embodiment of the disclosure.
Figure 8:
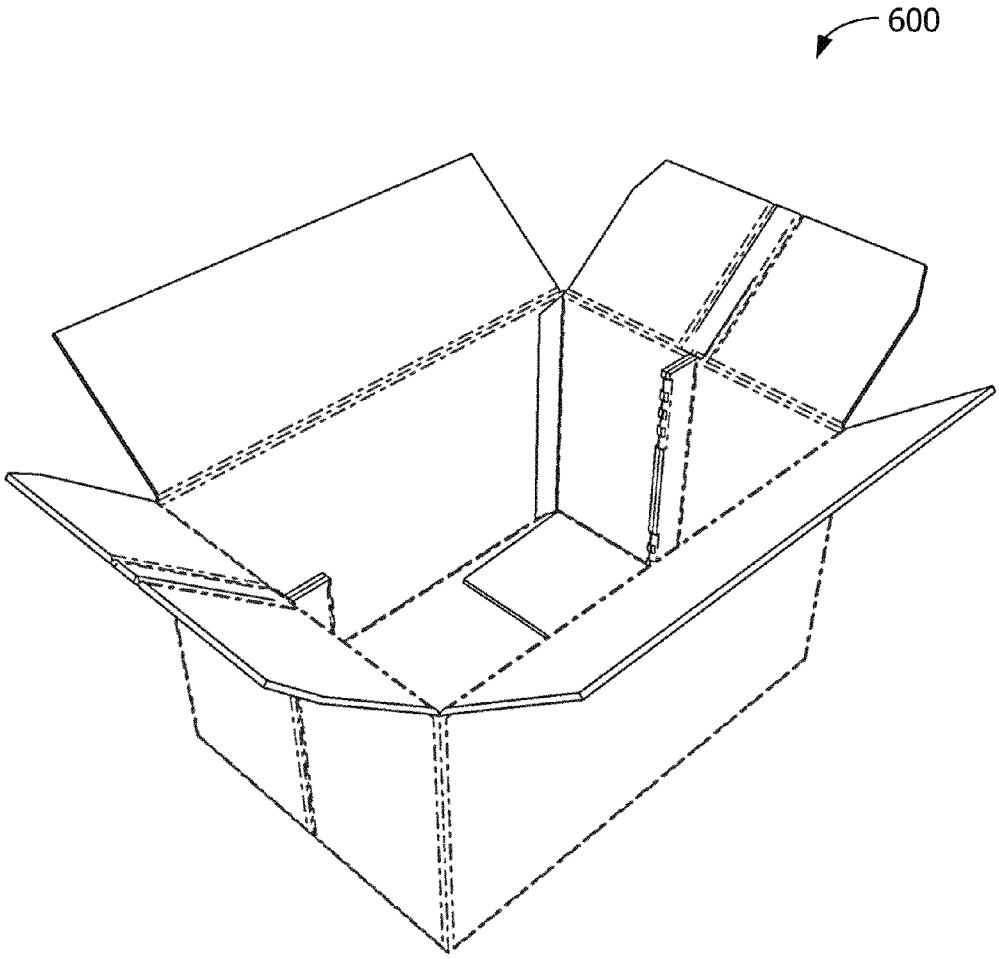
FIG. 8 is a perspective view of the container formed from the third blank of sheet material.

FIG. 7 is a top plan view of a third blank 500 of sheet material for forming a container 600 in accordance with another embodiment of the disclosure, and FIG. 8 is a perspective view of container 600 formed from third blank 500 of sheet material. In the example embodiment, third blank 500 includes, from a leading edge 516 to a trailing edge 518, a first side panel 522, a first end panel 526, a second side panel 530, a second end panel 534, and a joining tab 536 coupled together along preformed, generally parallel fold lines 542, 544, 550, and 552, respectively. As such, third blank 500 forms a four-sided container 600 similar to eight-sided container 400.

Figure 9:
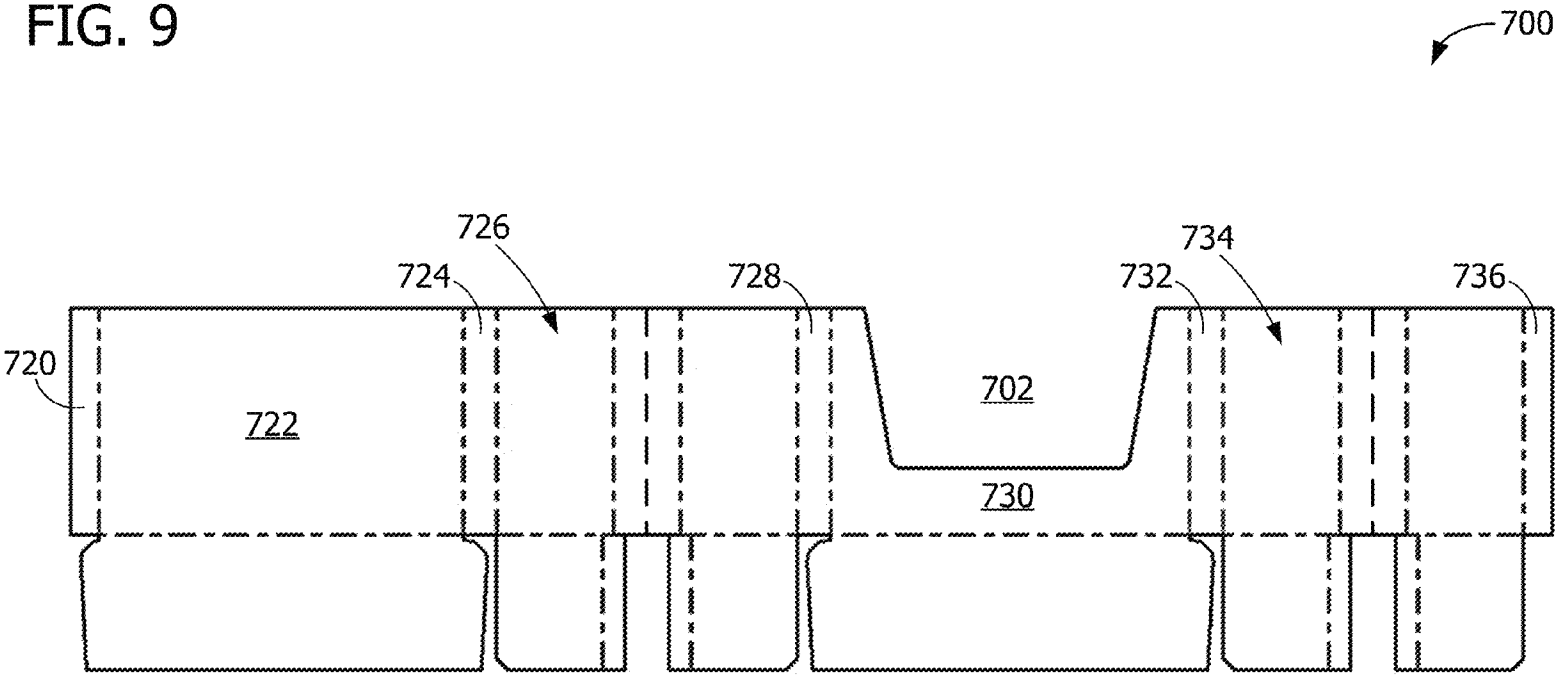
FIG. 9 is a top plan view of a fourth blank of sheet material for forming a container in accordance with another embodiment of the disclosure.
Figure 10:
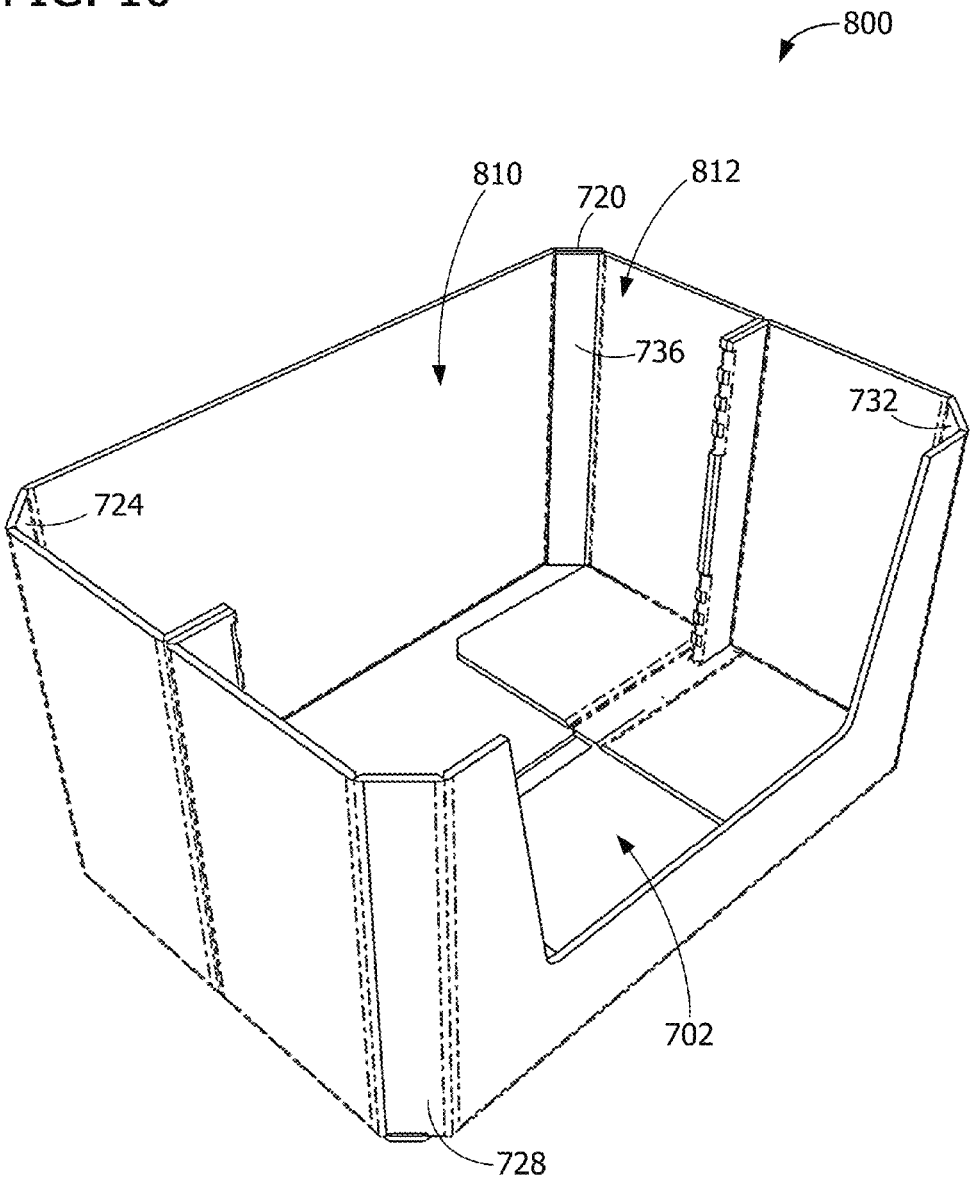
FIG. 10 is a perspective view of the container formed from the fourth blank of sheet material.

FIG. 9 is a top plan view of a fourth blank 700 of sheet material for forming a container 800 in accordance with another embodiment of the disclosure, and FIG. 10 is a perspective view of container 800 formed from fourth blank 700 of sheet material. In the example embodiment, an access opening 702 is defined in at least one of the two opposing side panels. More specifically, access opening 702 is defined in second side panel 730, which provides access and/or a view of products within interior cavity 810 of container 800. As such, products within container 800 can be removed therefrom through access opening 702.

Referring to FIG. 10, container 800 includes an open top 812 at least partially defined by top edges of glue joint panel 720, side panels 722 and 730, end panels 726 and 734, joining tab 736 and corner panels 724, 728, and 732 (each shown in FIG. 9). Open top 812 provides further access and/or a view of products within interior cavity 810 of container 800.

Figure 11:
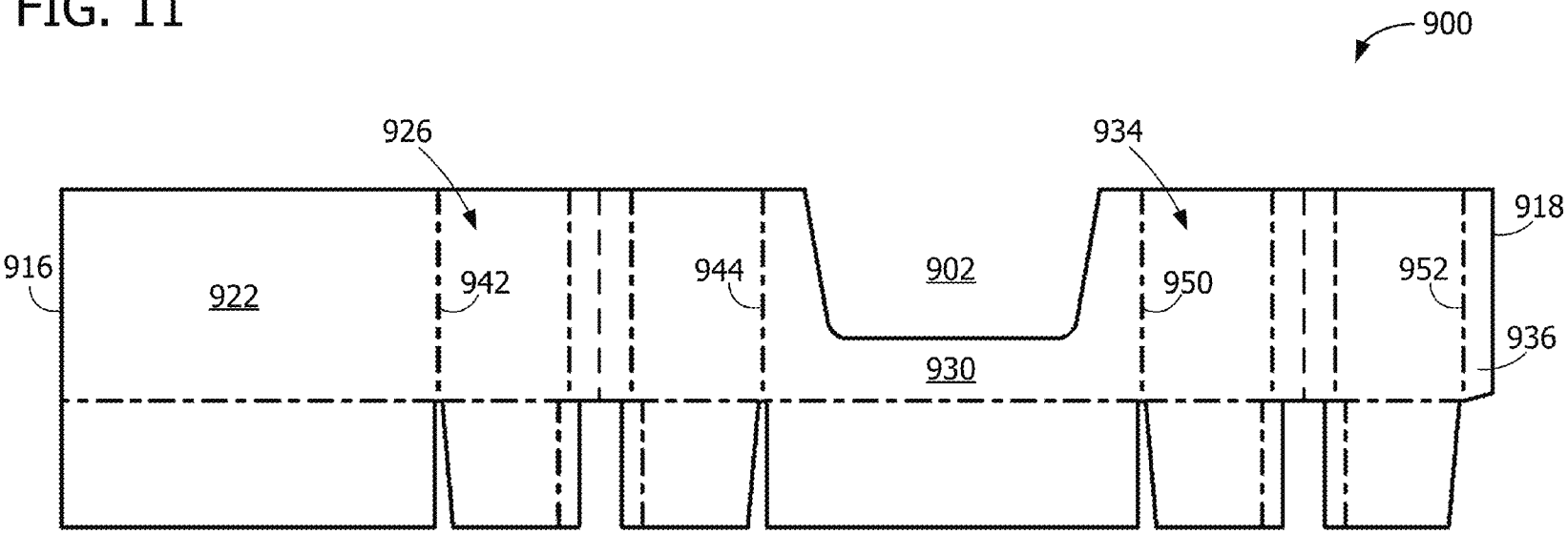
FIG. 11 is a top plan view of a fifth blank of sheet material for forming a container in accordance with another embodiment of the disclosure.
Figure 12:
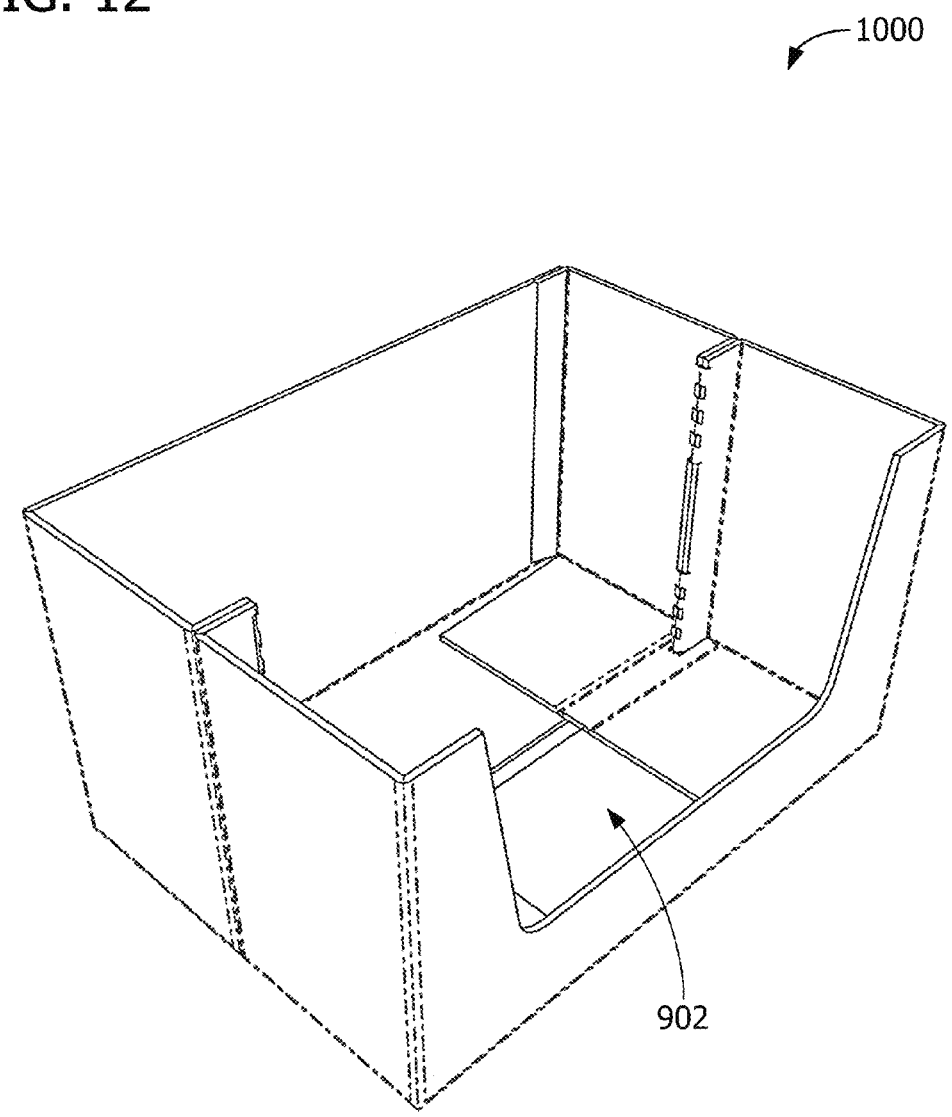
FIG. 12 is a perspective view of the container formed from the fifth blank of sheet material.

FIG. 11 is a top plan view of a fifth blank 900 of sheet material for forming a container 1000 in accordance with another embodiment of the disclosure, and FIG. 12 is a perspective view of container 1000 formed from fifth blank 900 of sheet material. In the example embodiment, fifth blank 900 includes, from a leading edge 916 to a trailing edge 918, a first side panel 922, a first end panel 926, a second side panel 930, a second end panel 934, and a joining tab 936 coupled together along preformed, generally parallel fold lines 942, 944, 950, and 952, respectively. An access opening 902 is defined in second side panel 930. As such, fifth blank 900 forms a four-sided container 1000 similar to eight-sided container 800.

Figure 13:
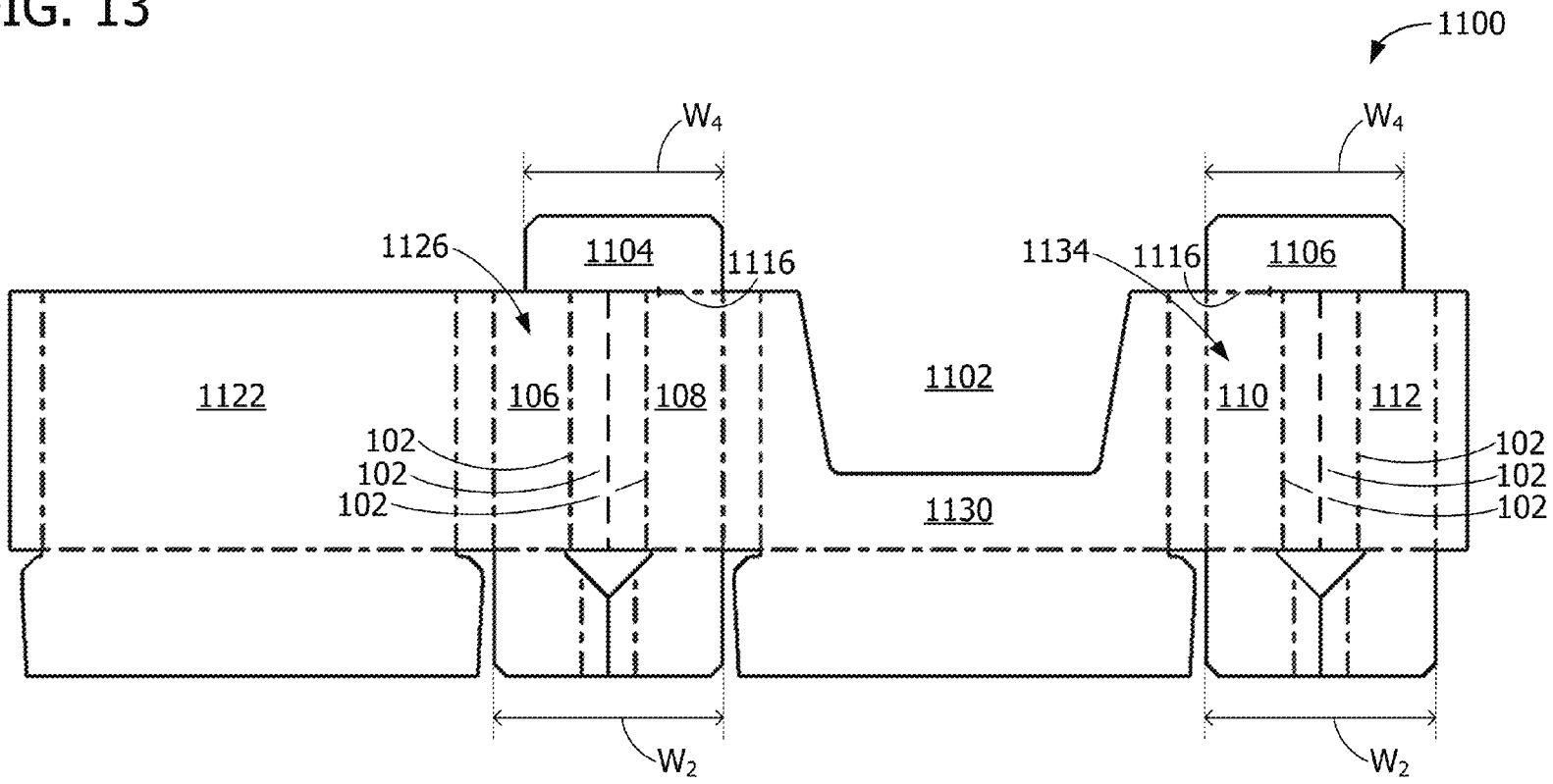
FIG. 13 is a top plan view of a sixth blank of sheet material for forming a container in accordance with another embodiment of the disclosure.
Figure 14:
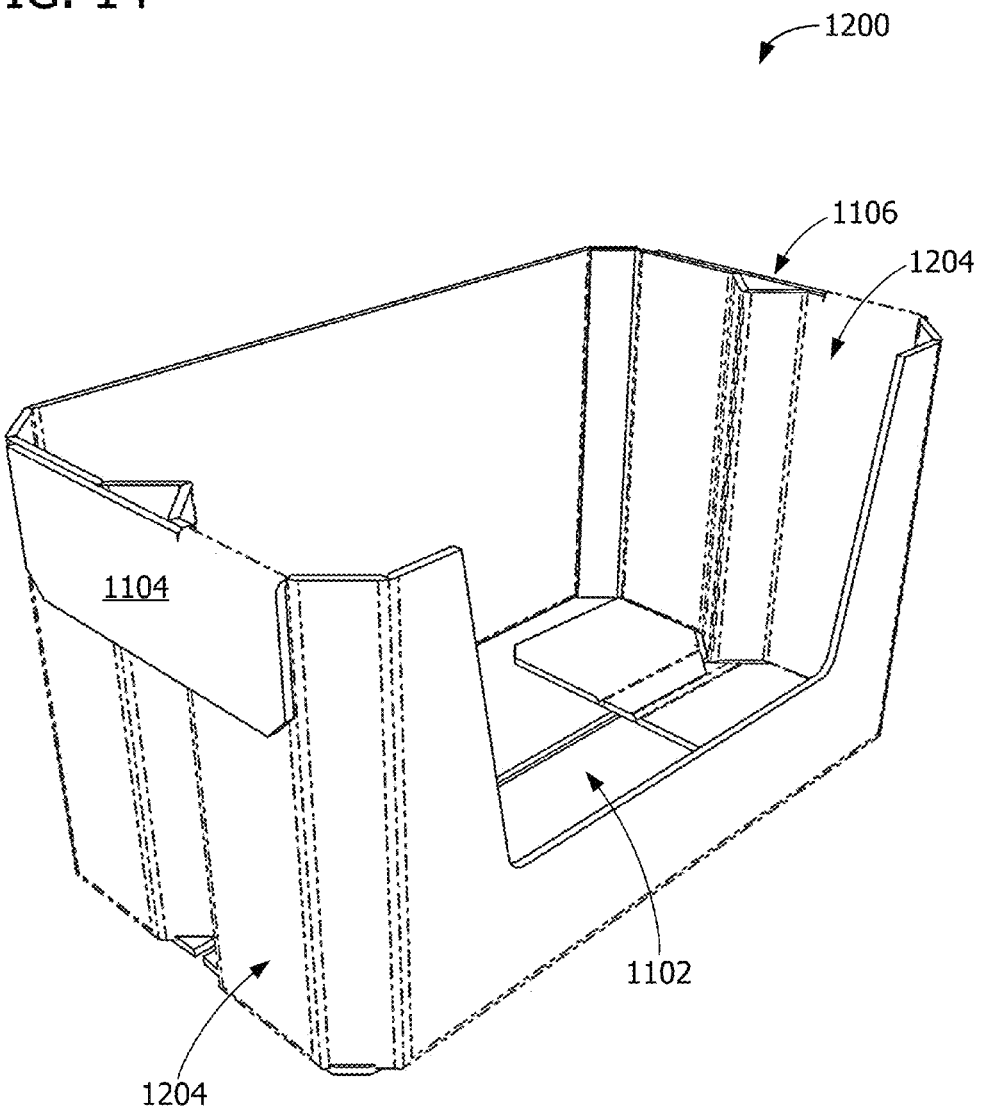
FIG. 14 is a perspective view of the container formed from the sixth blank of sheet material.

FIG. 13 is a top plan view of a sixth blank 1100 of sheet material for forming a container 1200 in accordance with another embodiment of the disclosure, and FIG. 14 is a perspective view of container 1200 formed from sixth blank 1100 of sheet material. In the example embodiment, sixth blank 1100 includes a top flap extending from top edge 1116 of each end panel 1126 and 1134. More specifically, a first top flap 1104 is coupled to one minor end panel 108 in end panel 1126, and a second top flap 1106 is coupled to one minor end panel 110 in end panel 1134. First and second top flaps 1104 and 1106 extend across top edges 1116 of end panels 1126 and 1134, and a width $W_4$ of top flaps 1104 and 1106 are less than width $W_2$ of end panels 1126 and 1134. As such, when forming container 1200, end panels 1126 and 1134 are folded along the plurality of fold lines 102 until the width of end walls 1204 are substantially equal to width $W_4$ of top flaps 1104 and 1106. An access opening 1102 is defined in second side panel 1130. Moreover, referring to FIG. 14, first and second top flaps 1104 and 1106 are foldable to couple to each respective end panel 1126 and 1134. In one embodiment, first and second top flaps 1104 and 1106 are glued to end panels 1126 and 1134.

Figure 15:
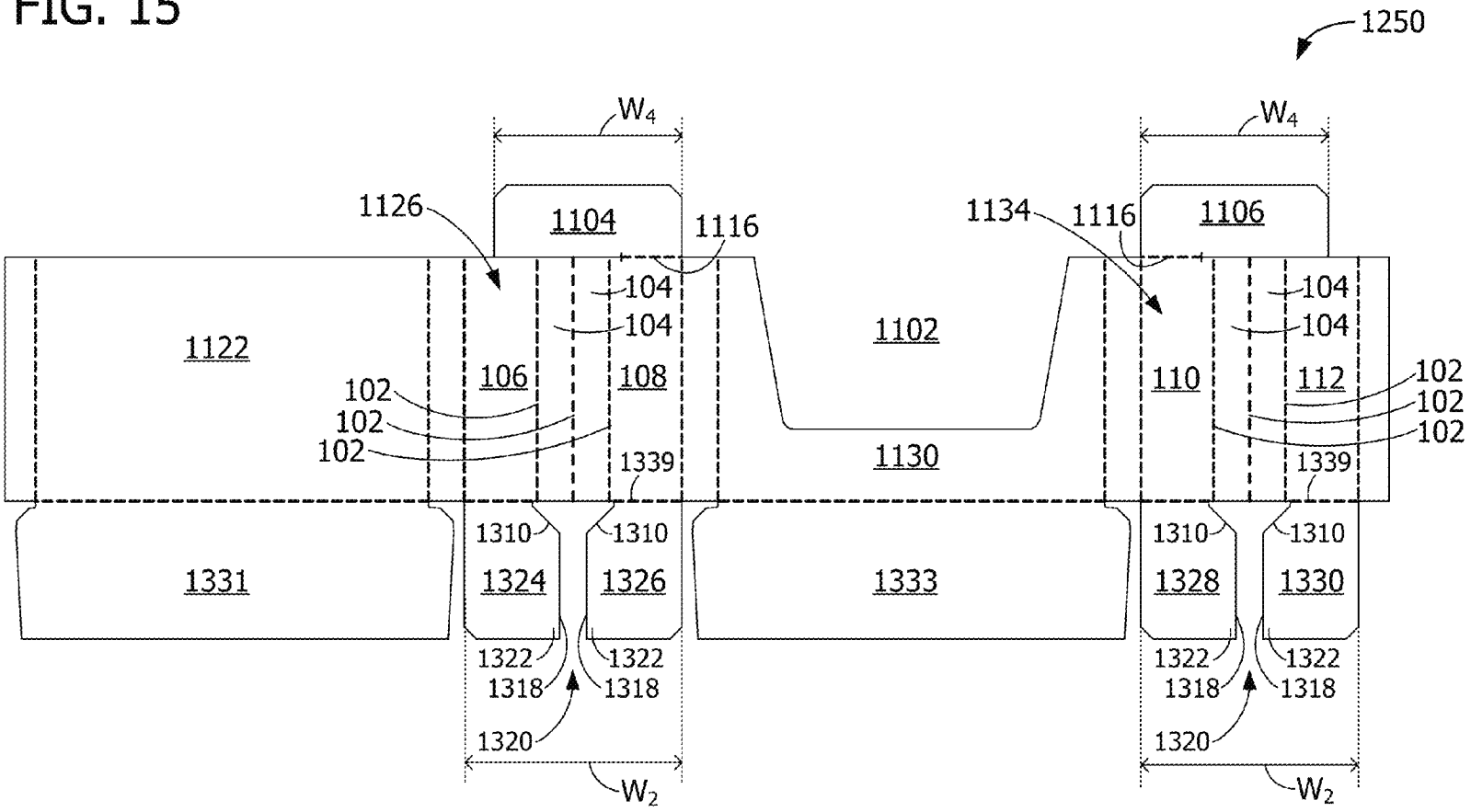
FIG. 15 is a top plan view of a seventh blank of sheet material for forming a container in accordance with another embodiment of the disclosure.
Figure 18:
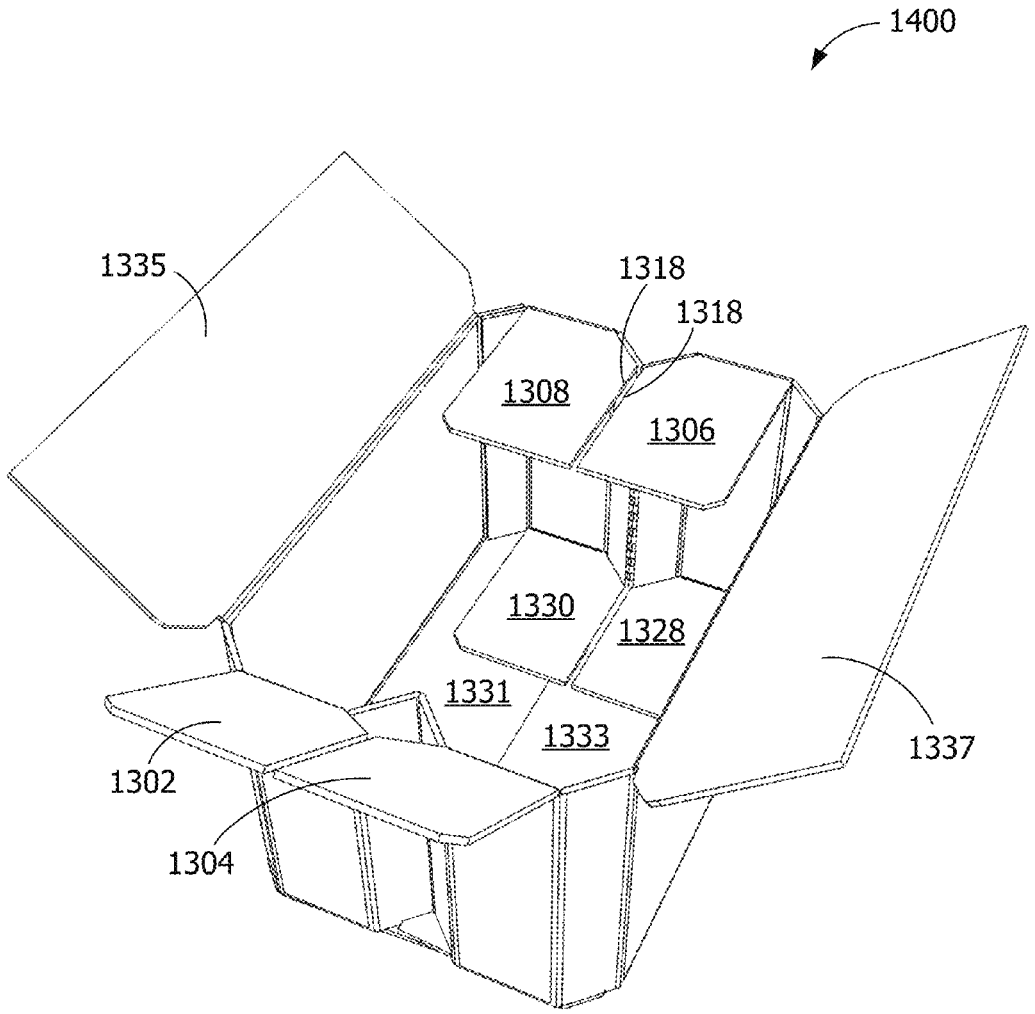
FIG. 18 is a perspective view of the container formed from the eighth blank of sheet material.

FIG. 15 is a top plan view of a seventh blank 1250 of sheet material for forming a container 1252 in accordance with another embodiment of the disclosure, and FIG. 18 is a perspective view of container 1252 formed from seventh blank 1250 of sheet material. Seventh blank 1250 includes minor bottom flaps 1324, 1326, 1328, and 1330 that each include an angled edge portion 1310 extending from a bottom edge 1339 of each end panel 1126 and 1134. Minor bottom flaps 1324, 1326, 1328, and 1330 also include a straight edge portion 1318 extending from each angled edge portion 1310 such that adjacent minor bottom flaps 1324, 1326, 1328, and 1330 are separated by a gap 1320 having a length less than a width of reinforcement panels 104 in each end panel 1126 and 1134. As such, first portions 1322 of minor top flaps 1324, 1326, 1328, and 1330 do not overlap when end panels 1126 and 1134 are folded along the plurality of fold lines 102.

Figure 16:
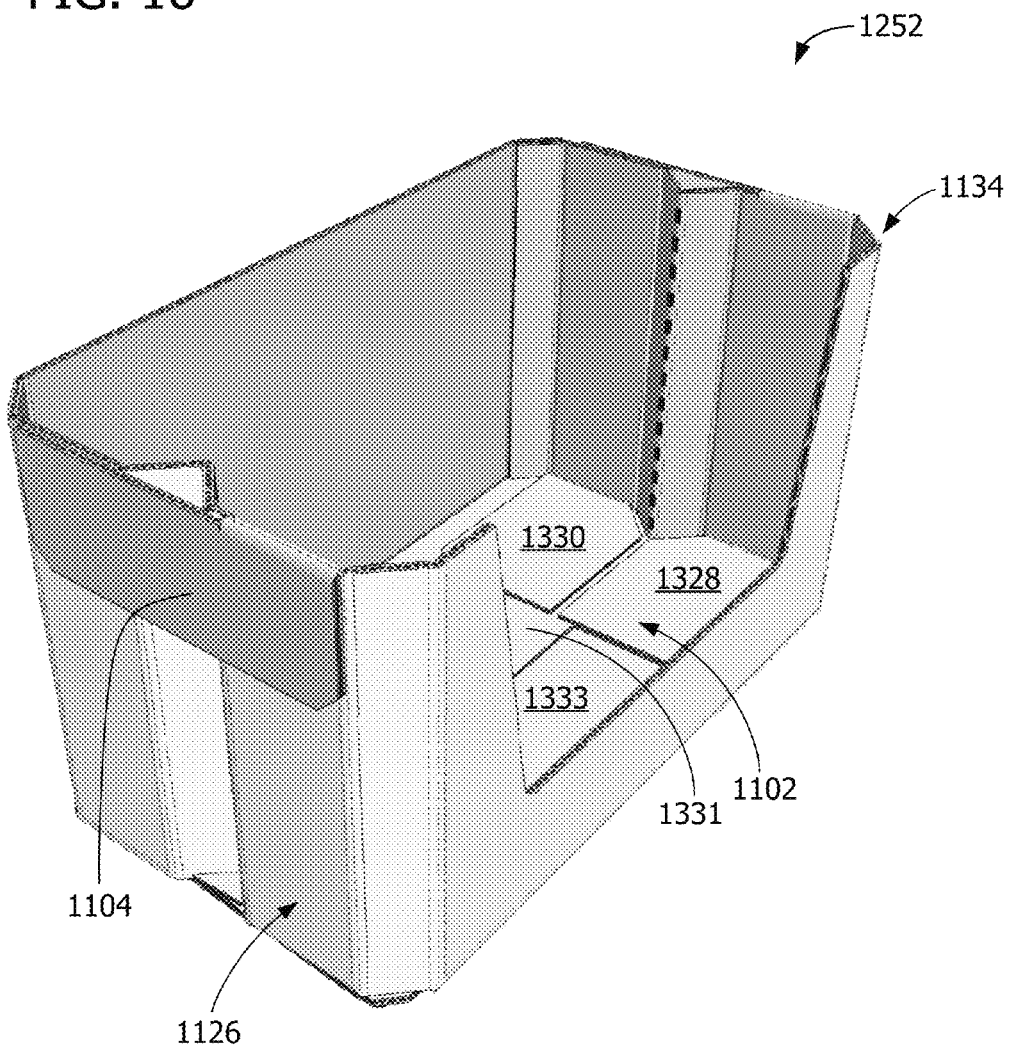
FIG. 16 is a perspective view of the container formed from the seventh blank of sheet material.

Moreover, referring to FIG. 16, first and second top flaps 1104 and 1106 are foldable to couple to each respective end panel 1126 and 1134. In one embodiment, first and second top flaps 1104 and 1106 are glued to end panels 1126 and 1134. Seventh blank 1250 also includes a first major bottom flap 1331 and a second major bottom flap 1333. When forming container 1252, at least a portion of first and second major bottom flaps 1331 and 1333 overlap with each other and are glued together to facilitate stabilizing container 1252 during formation thereof. More specifically, in the case when container 1252 is formed on a machine having a mandrel, flaps 1331 and 1333 are folded over and glued during the formation process such that container 1252 is maintained in an erected position, as will be described in more detail below.

Figure 17:
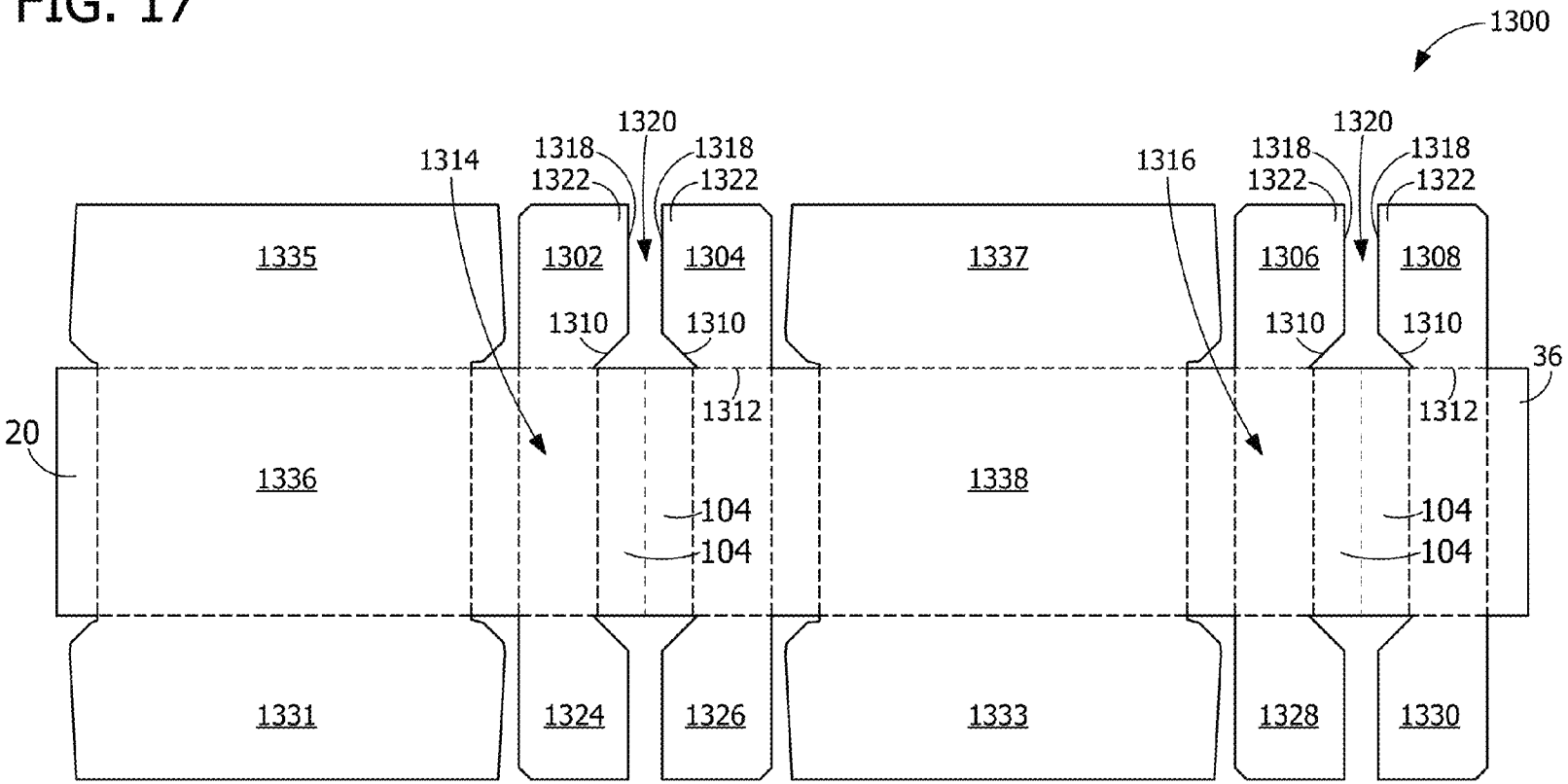
FIG. 17 is a top plan view of an eighth blank of sheet material for forming a container in accordance with another embodiment of the disclosure.

FIG. 17 is a top plan view of an eighth blank 1300 of sheet material for forming a container 1400 in accordance with another embodiment of the disclosure, and FIG. 18 is a perspective view of container 1400 formed from eighth blank 1300 of sheet material. In the example embodiment, eighth blank 1300 includes minor top flaps 1302, 1304, 1306, and 1308 that each include an angled edge portion 1310 extending from a top edge 1312 of each end panel 1314 and 1316. Minor top flaps 1302, 1304, 1306, and 1308 also include a straight edge portion 1318 extending from each angled edge portion 1310 such that adjacent minor top flaps 1302, 1304, 1306, and 1308 are separated by a gap 1320 having a length less than a width of reinforcement panels 104 in each end panel 1314 and 1316. As such, first portions 1322 of minor top flaps 1302, 1304, 1306, and 1308 do not overlap when end panels 1314 and 1316 are folded along the plurality of fold lines 102. Eighth blank 1300 also includes minor bottom flaps 1324, 1326, 1328, and 1330 that are configured similarly to minor top flaps 1302, 1304, 1306, and 1308.

Moreover, eighth blank 1300 includes first major bottom flap 1331, second major bottom flap 1333, first major top flap 1335, and second major top flap 1337. Referring to FIG. 18, when forming container 1400, at least a portion of first and second major bottom flaps 1331 and 1333 overlap with each other and are glued together to facilitate stabilizing container 1400 during formation thereof. Moreover, minor bottom flaps 1324, 1326, 1328, and 1330 are glued to first and second major bottom flaps 1331 and 1333 to facilitate stabilizing container 1400. As such, as will be described in more detail below, gluing bottom flaps 1324, 1326, 1328, and 1330, and flaps 1331 and 1333 together enables container 1400 to be formed on a mandrel.

Figure 19:
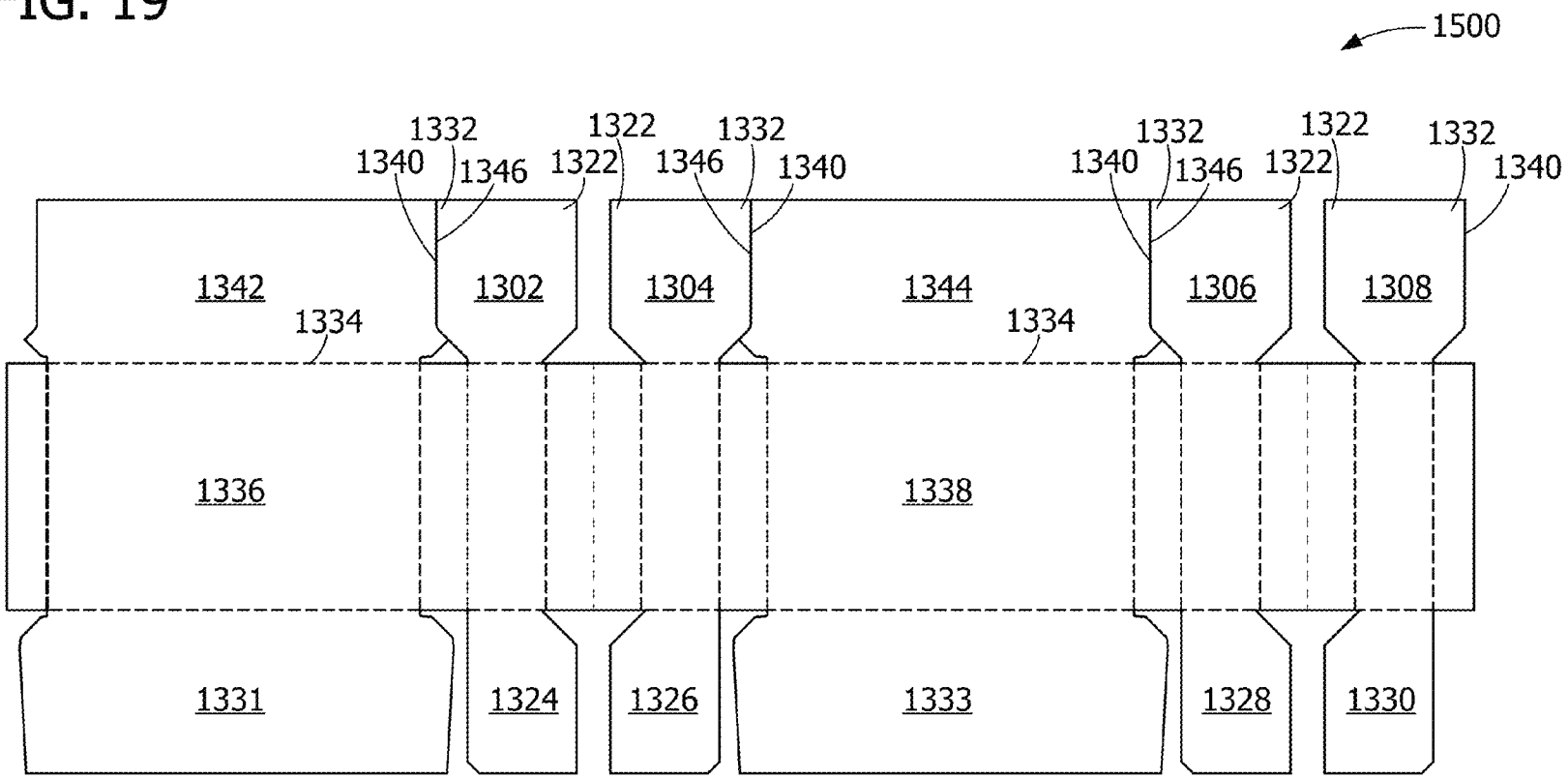
FIG. 19 is a top plan view of a ninth blank of sheet material for forming a container in accordance with another embodiment of the disclosure.
Figure 20:
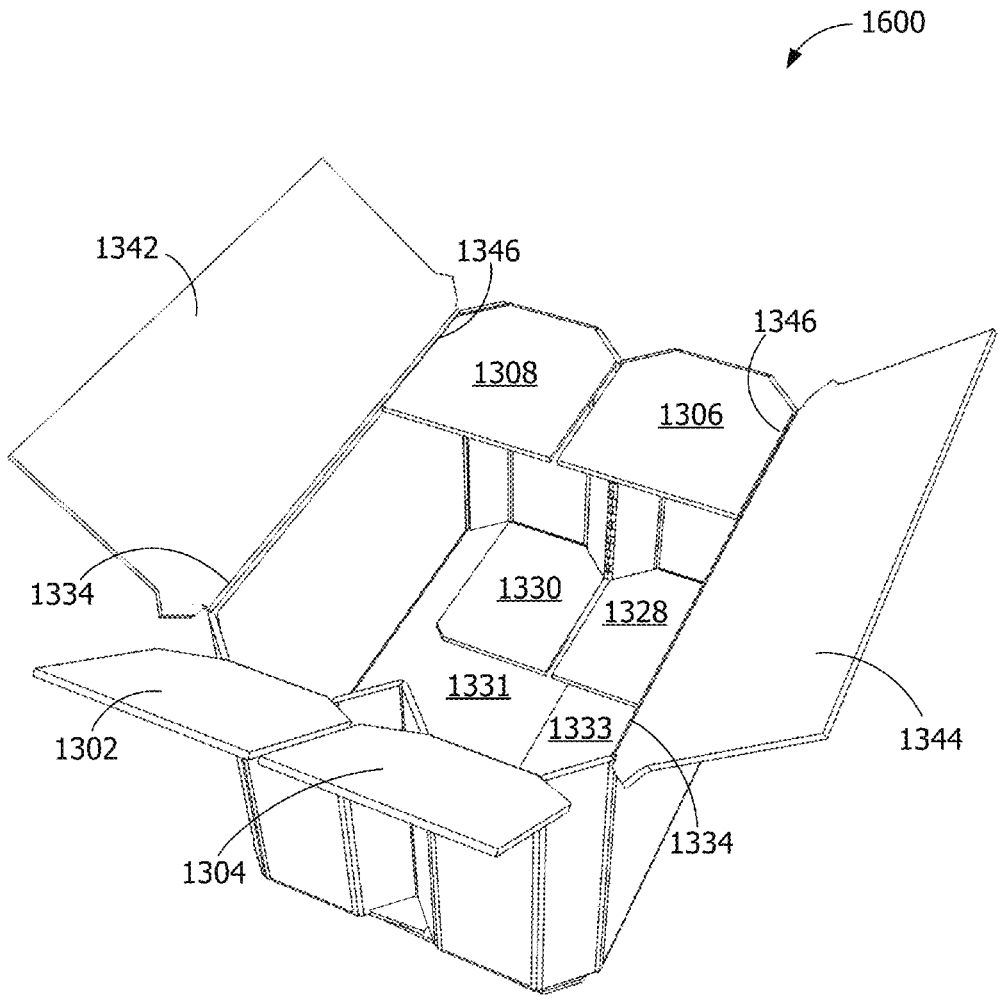
FIG. 20 is a perspective view of the container formed from the ninth blank of sheet material.

FIG. 19 is a top plan view of a ninth blank 1500 of sheet material for forming a container 1600 in accordance with another embodiment of the disclosure, and FIG. 20 is a perspective view of container 1600 formed from ninth blank 1500 of sheet material. In the example embodiment, minor top flaps 1302, 1304, 1306, and 1308 each include first portions 1322 and second portions 1332 that extend from opposing sides of each minor top flap 1302, 1304, 1306, and 1308. As such, when container 1600 is formed, second portions 1332 extend towards top edges 1334 of side panels 1336 and 1338. More specifically, a cut line 1340 is defined between first minor top flap 1302 and a first top flap 1342, and cut line 1340 is defined between second minor top flap 1304 and a second top flap 1344, and cut line 1340 is defined between third minor top flap 1306 and second top flap 1344. As such, side edges 1346 of second portions 1332 extend along top edges 1334 when container 1600 is formed.

Figure 21:
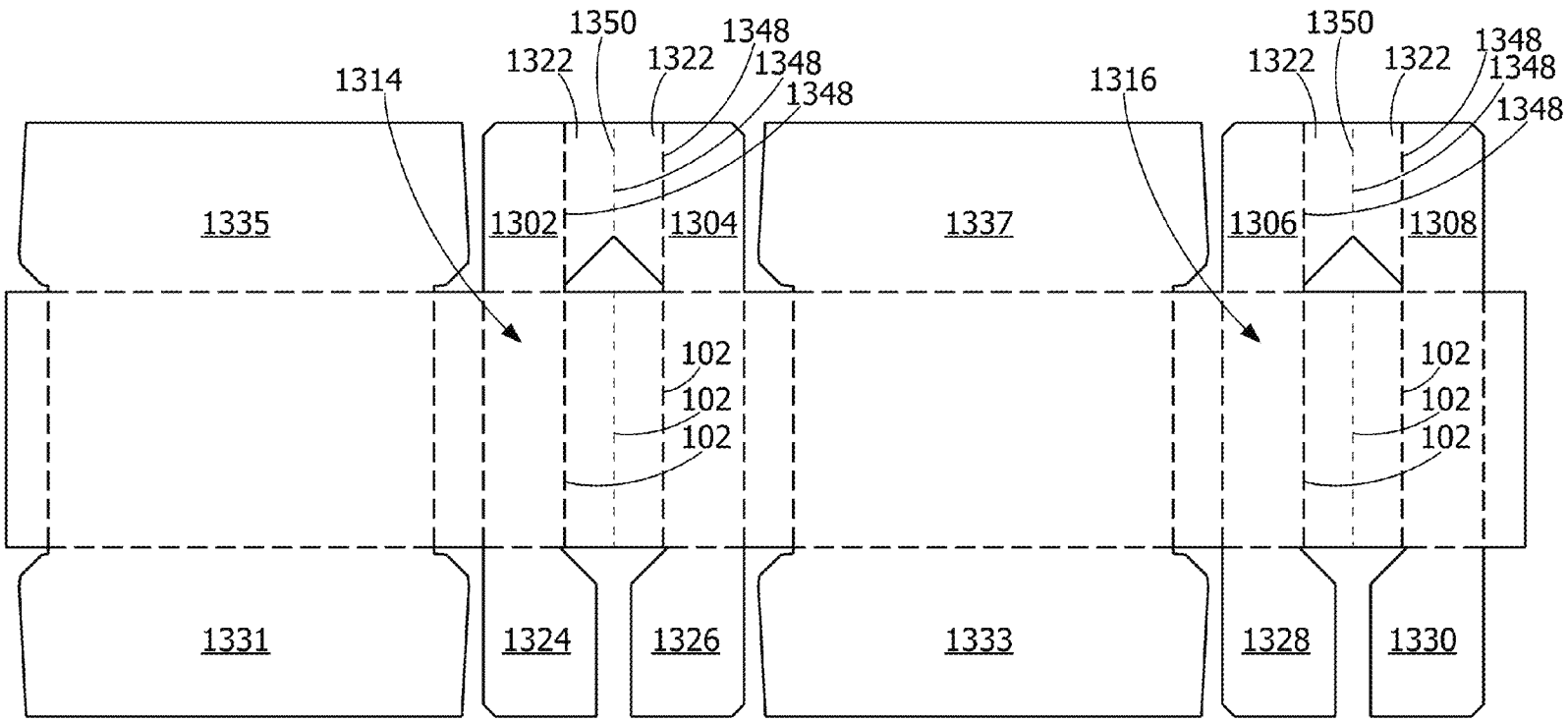
FIG. 21 is a top plan view of a tenth blank of sheet material for forming a container in accordance with another embodiment of the disclosure.
Figure 22:
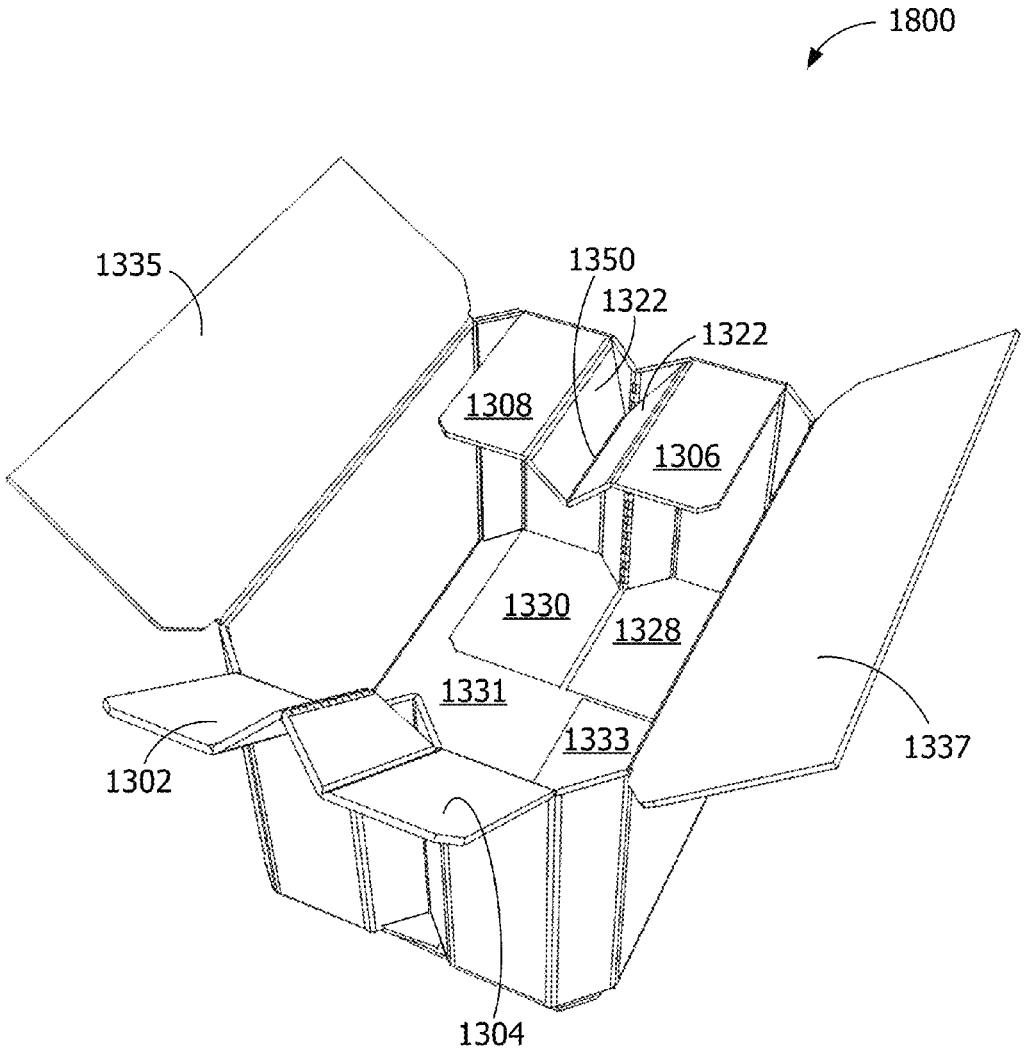
FIG. 22 is a perspective view of the container formed from the tenth blank of sheet material.

FIG. 21 is a top plan view of a tenth blank 1700 of sheet material for forming a container 1800 in accordance with another embodiment of the disclosure, and FIG. 22 is a perspective view of container 1800 formed from tenth blank 1700 of sheet material. In the example embodiment, minor top flaps 1302 and 1304 include a plurality of fold lines 1348 substantially aligned with fold lines 102 in end panel 1314, and minor top flaps 1306 and 1308 include a plurality of fold lines 1348 substantially aligned with fold lines 102 in end panel 1316. More specifically, a center fold line 1350 is defined between adjacent minor top flaps. As such, when container 1800 is formed, minor top flaps 1302, 1304, 1306, and 1308 fold along fold lines 1348 such that first portions 1322 move inwardly towards an internal cavity of container 1800.

Figure 23:
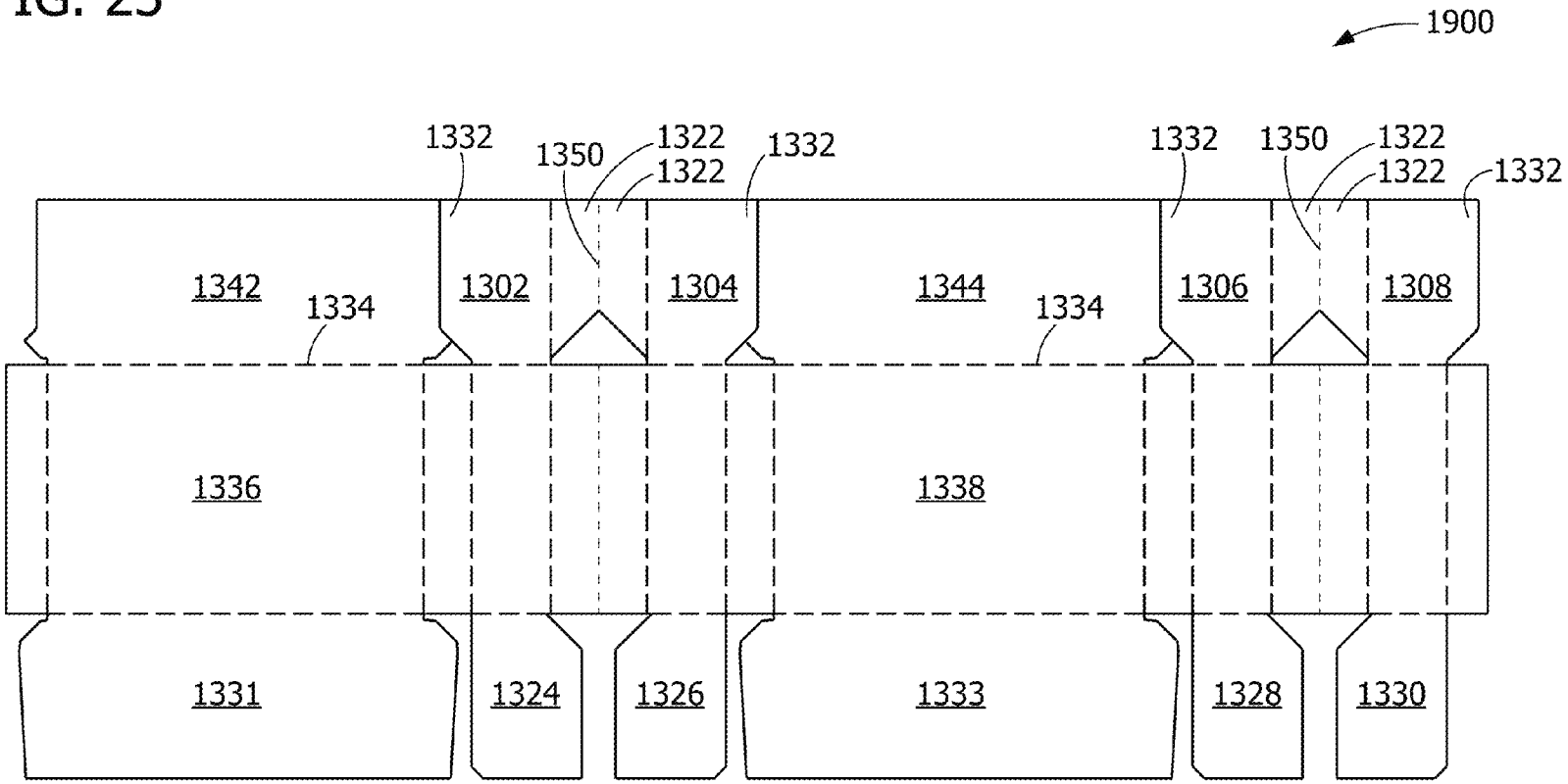
FIG. 23 is a top plan view of an eleventh blank of sheet material for forming a container in accordance with another embodiment of the disclosure.
Figure 24:
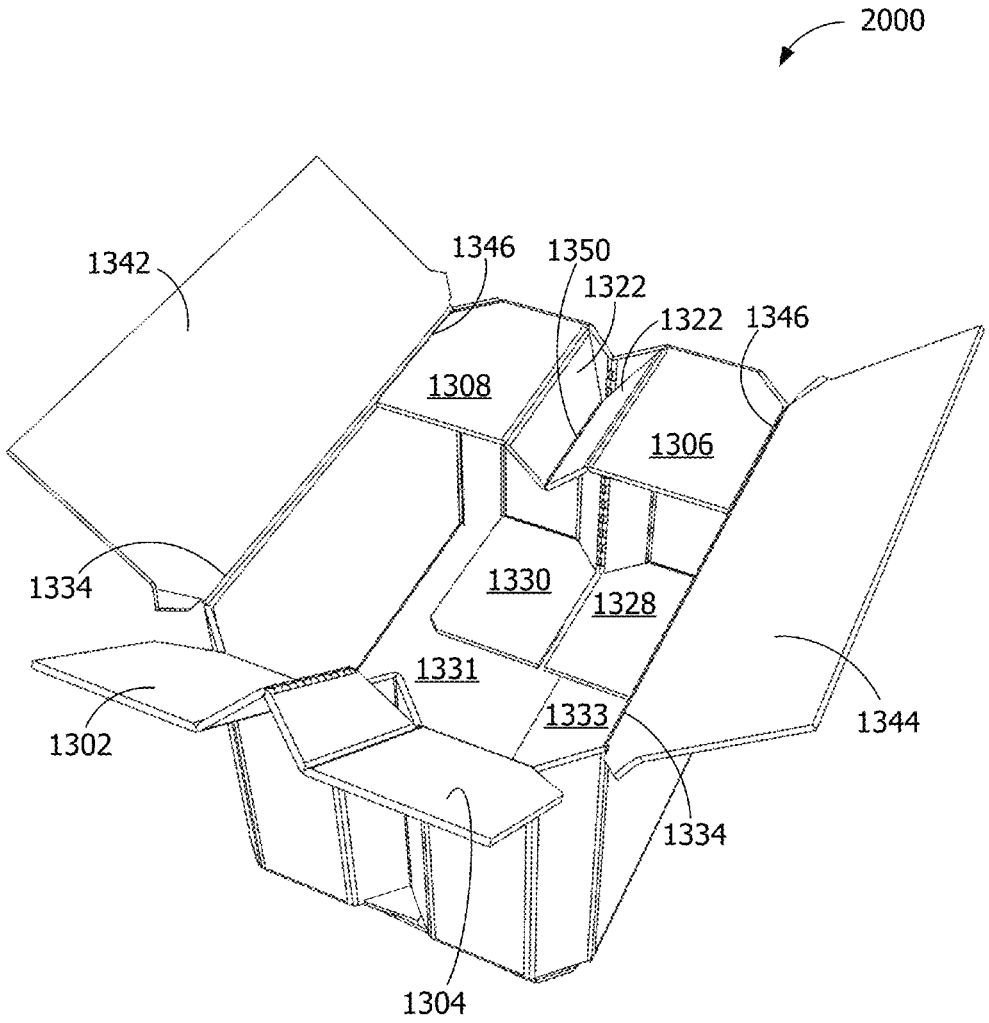
FIG. 24 is a perspective view of the container formed from the eleventh blank of sheet material.

FIG. 23 is a top plan view of a eleventh blank 1900 of sheet material for forming a container 2000 in accordance with another embodiment of the disclosure, and FIG. 24 is a perspective view of container 2000 formed from eleventh blank 1900 of sheet material. In the example embodiment, minor top flaps 1302, 1304, 1306, and 1308 each include first portions 1322 and second portions 1332 that extend from opposing sides of each minor top flap 1302, 1304, 1306, and 1308. As such, when container 2000 is formed, second portions 1332 extend towards top edges 1334 of side panels 1336 and 1338.

Figure 25:
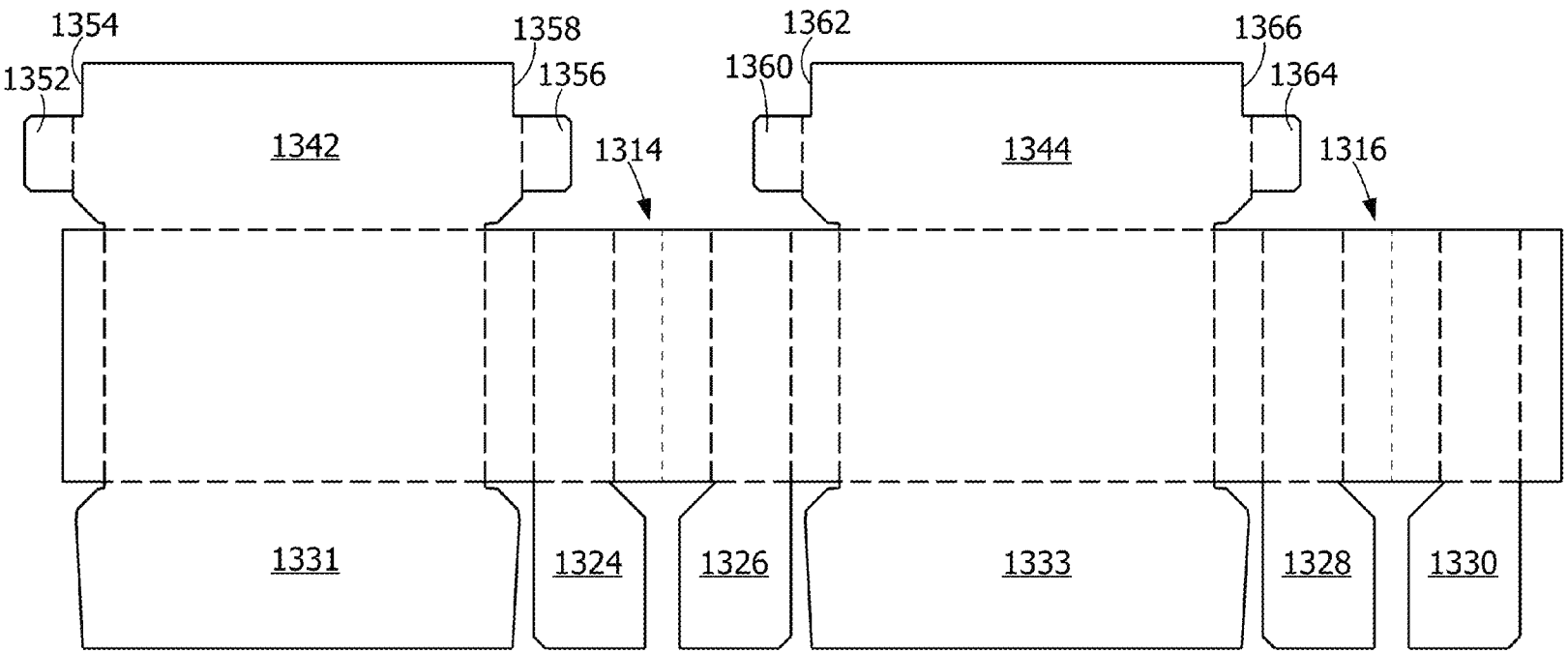
FIG. 25 is a top plan view of a twelfth blank of sheet material for forming a container in accordance with another embodiment of the disclosure.
Figure 26:
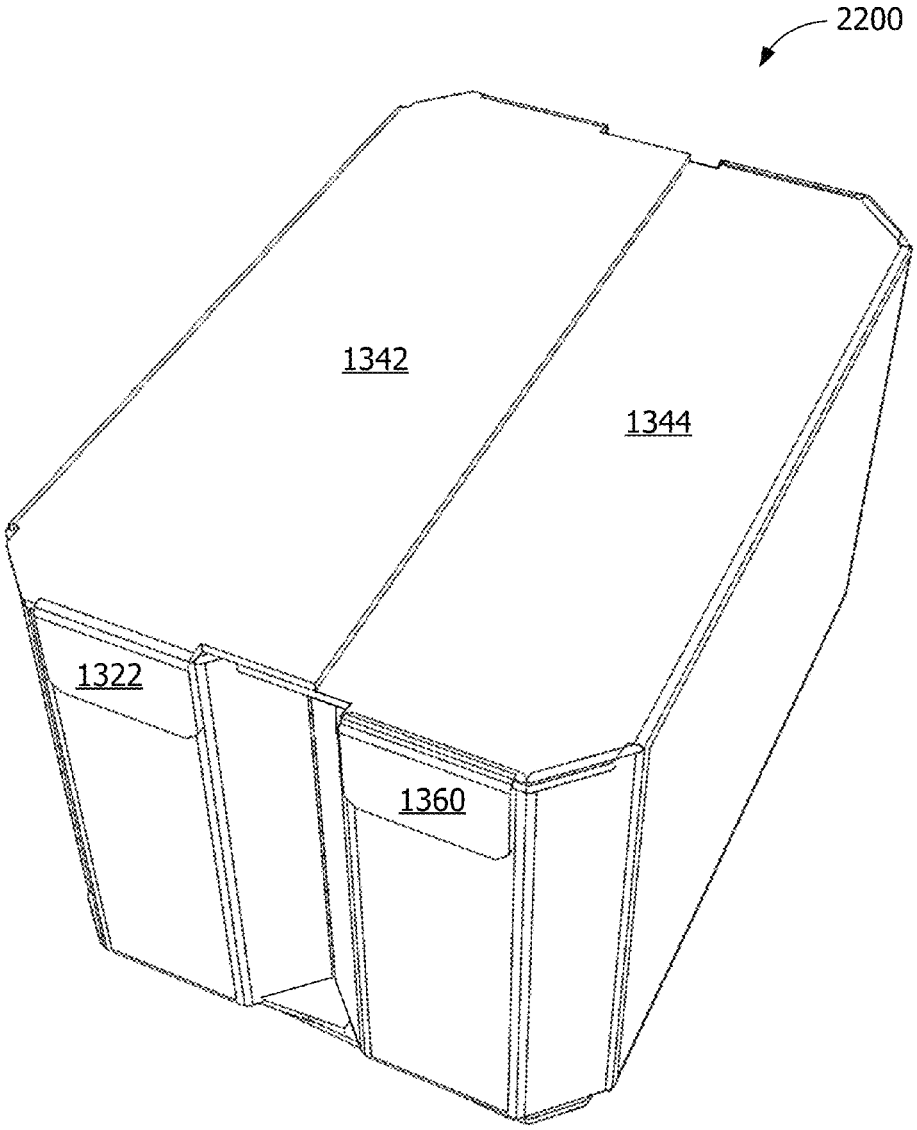
FIG. 26 is a perspective view of the container formed from the twelfth blank of sheet material.

FIG. 25 is a top plan view of a twelfth blank 2100 of sheet material for forming a container 2200 in accordance with another embodiment of the disclosure, and FIG. 26 is a perspective view of container 2200 formed from twelfth blank 2100 of sheet material. In the example embodiment, blank 2100 includes a first coupling flap 1352 extending from a first side edge 1354 of first top flap 1342, a second coupling flap 1356 extending from a second side edge 1358 of first top flap 1342, a third coupling flap 1360 extending from a first side edge 1362 of second top flap 1344, and a fourth coupling flap 1364 extending from a second side edge 1366 of second top flap 1344. As such, when container 2200 is formed, coupling flaps 1352, 1356, 1360, and 1364 couple (e.g., are glued) to an external surface of respective end panels 1314 and 1316 to facilitate closing container 2200. Moreover, first and second top flaps 1342 and 1344 overlap with each other and, in one embodiment, are glued together to facilitate closing container 2200.

Figure 27:
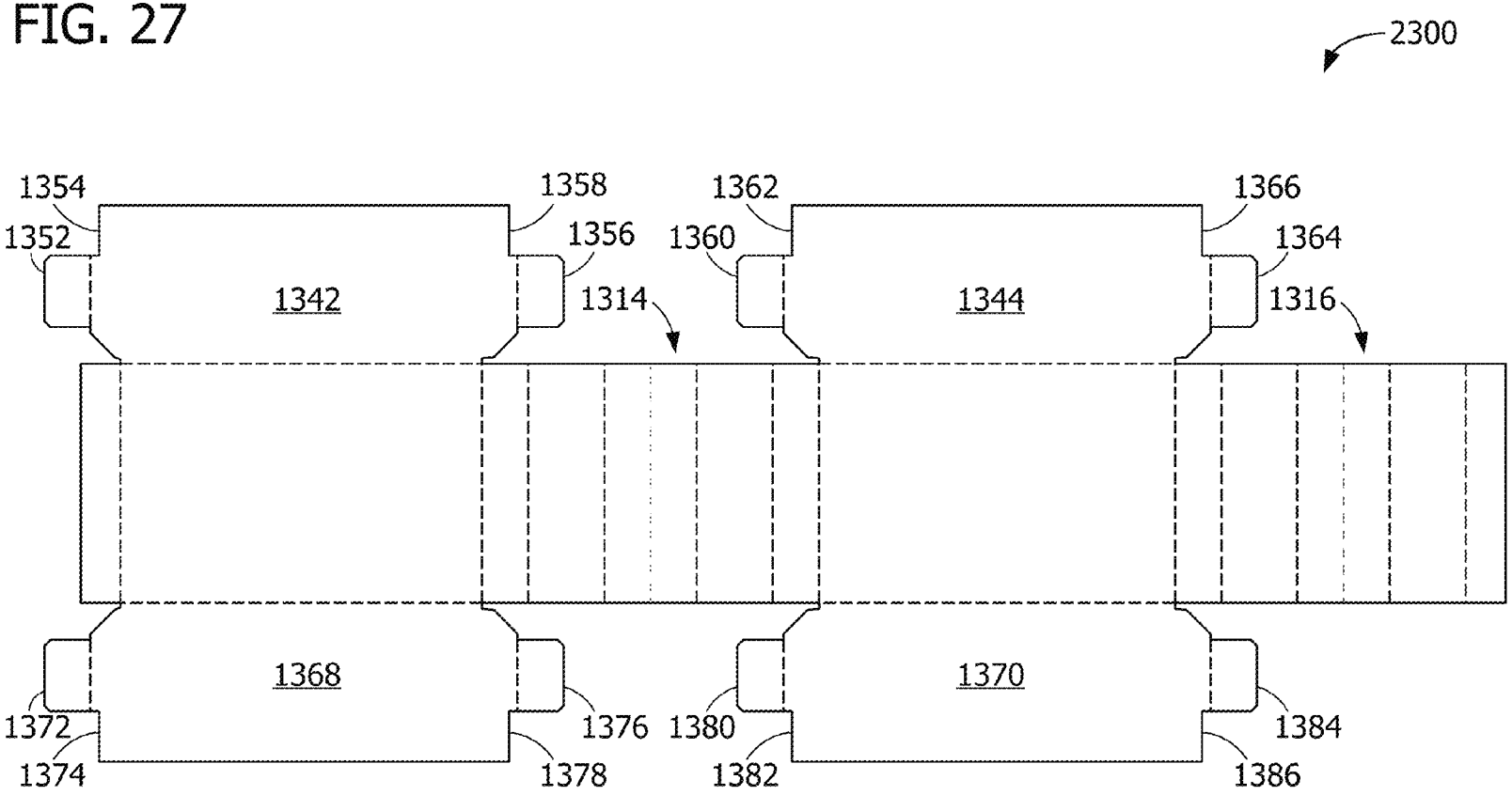
FIG. 27 is a top plan view of a thirteenth blank of sheet material for forming a container in accordance with another embodiment of the disclosure.
Figure 28:
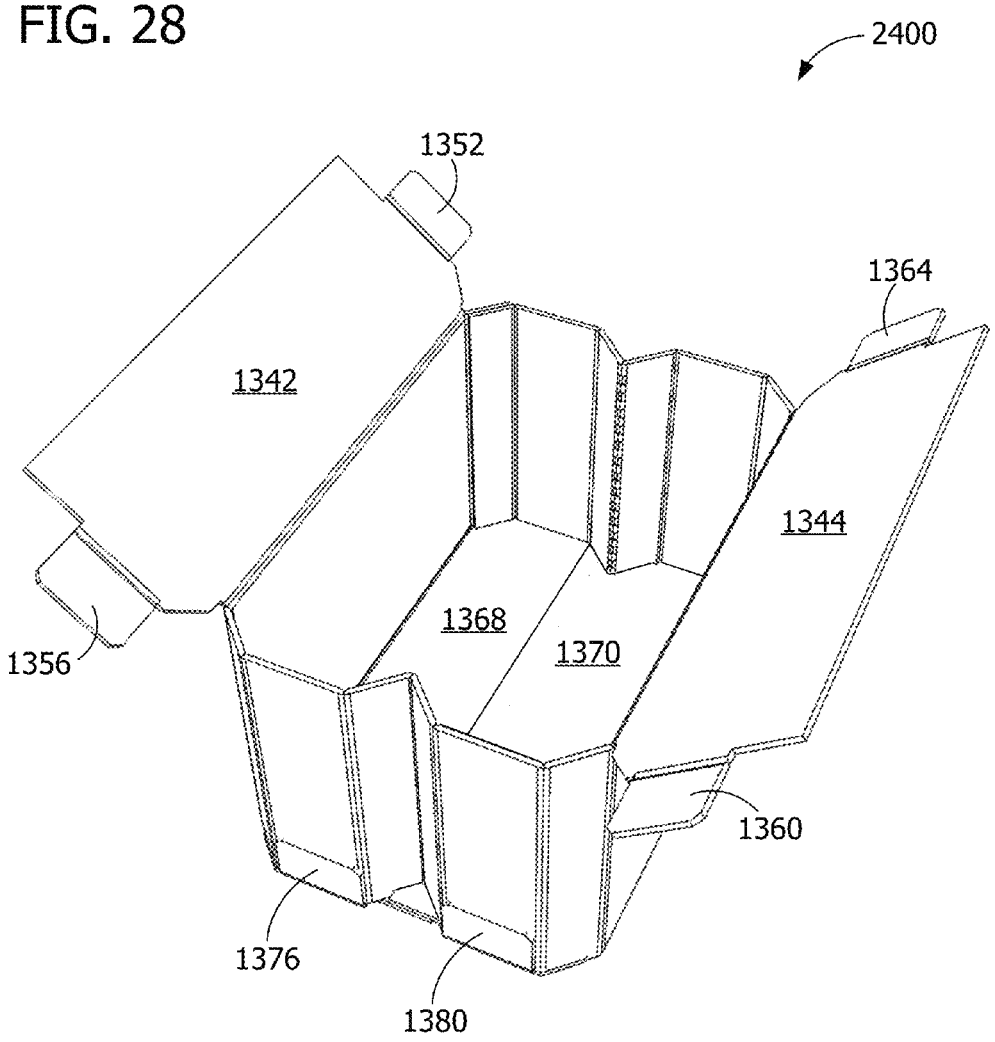
FIG. 28 is a perspective view of the container formed from the thirteenth blank of sheet material.

FIG. 27 is a top plan view of a thirteenth blank 2300 of sheet material for forming a container 2400 in accordance with another embodiment of the disclosure, and FIG. 28 is a perspective view of container 2400 formed from thirteenth blank 2300 of sheet material. In the example embodiment, blank 2300 includes a first bottom flap 1368 and a second bottom flap 1370. Blank 2300 also includes a fifth coupling flap 1372 extending from a first side edge 1374 of first bottom flap 1368, a sixth coupling flap 1376 extending from a second side edge 1378 of first bottom flap 1368, a seventh coupling flap 1380 extending from a first side edge 1382 of second bottom flap 1370, and an eighth coupling flap 1384 extending from a second side edge 1386 of second bottom flap 1370. As such, when container 2400 is formed, coupling flaps 1372, 1376, 1380, and 1384 couple to an external surface of respective end panels 1314 and 1316 to facilitate closing container 2400. In one embodiment, coupling flaps 1372, 1376, 1380, and 1384 are glued to end panels 1314 and 1316. Referring to FIG. 28, when forming container 2400, at least a portion of first and second bottom flaps 1368 and 1370 overlap with each other and, in one embodiment, are glued together to facilitate stabilizing container 2400 during formation thereof. Alternatively, either coupling flaps 1372, 1376, 1380, and 1384 and first and second bottom flaps 1368 and 1370 are glued together to form container 2400.

Figure 29:
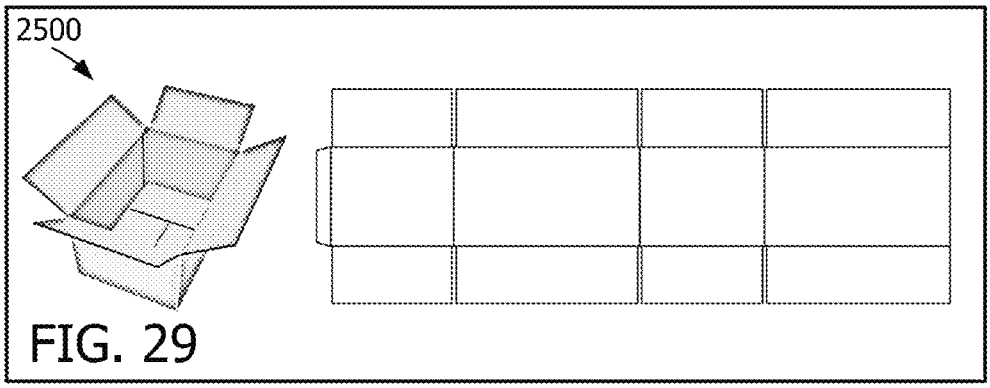
FIG. 29 is a top plan view and a perspective view of an example four-sided container without a reinforcement structure.
Figure 30:
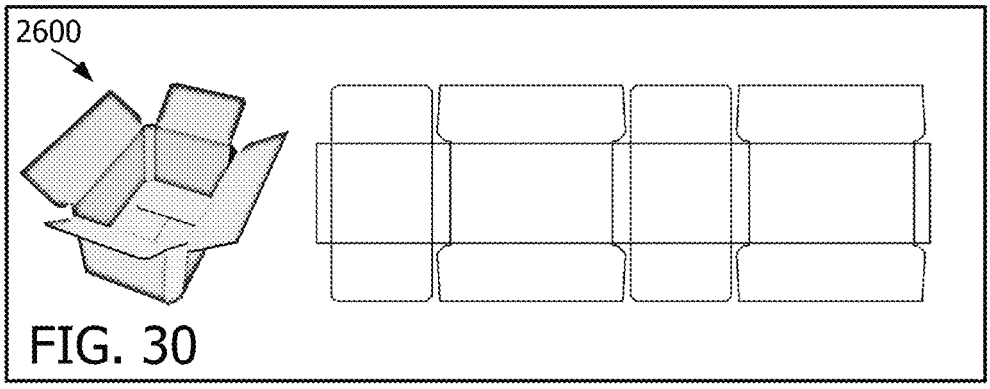
FIG. 30 is a top plan view and a perspective view of an example eight-sided container.

FIG. 29 is a top plan view and a perspective view of an example four-sided container 2500 without a reinforcement structure, and FIG. 30 is a top plan view and a perspective view of an example eight-sided container 2600. Containers 200, 2500, and 2600 were subjected to a series of compression tests to determine the compression strength of each container. More specifically, containers 200, 2500, and 2600 were formed from the same blank of sheet material, wherein the blank of sheet material was stored at a temperature of about 70° F. and at a relative humidity of about 50%. Containers 200, 2500, and 2600 were then subjected to a dynamic compression test that compressed the containers until failure. As used herein, "tare weight" refers to the weight of a formed container without any product in the container.

TABLE 1

| Container | Area of Blank (sq ft.) | Tare Weight (lbs) | Compression strength (psi) | Efficiency (compression/lb of fiber) |
|---|---|---|---|---|
| 200 | 9.6191 | 1.551 | 1620 | 1044.49 |
| 2500 | 9.6680 | 1.558 | 1020 | 654.69 |
| 2600 | 9.2969 | 1.499 | 1260 | 840.56 |

As shown in Table 1, each of containers 200, 2500, and 2600 had similar blank areas and fiber weights. However, the configuration of container 200 resulted in an increased compression strength when compared to containers 2500 and 2600. More specifically, container 200 had a 37% improvement in compression strength when compared to container 2500, and container 200 had a 22% improvement in compression strength when compared to container 2600. Thus, reinforcement structure 212 provides a significant increase in the stacking strength of the container without increasing the need for additional blank material.

Figure 31:
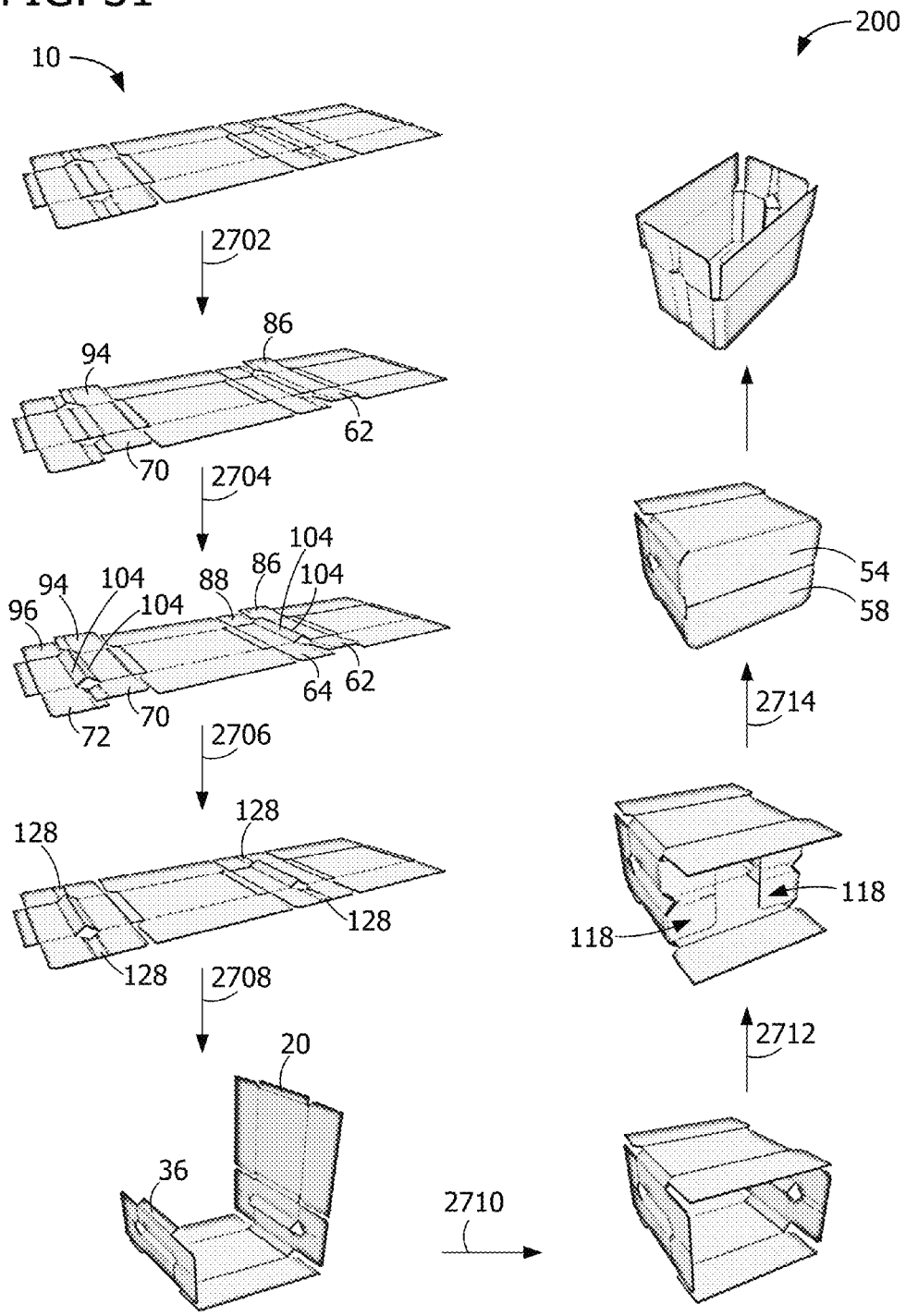
FIG. 31 illustrates an exemplary series of process steps for forming the container shown in FIG. 2.

FIG. 31 illustrates an exemplary series of process steps for forming container 200. In the example embodiment, container 200 is formed from blank 10 in a first process step 2702 that includes moving minor bottom flaps 62 and 70, and minor top flaps 86 and 94 inwardly from the remainder of blank 10. A second process step 2704 includes folding blank 10 about fold lines such that reinforcement panels 104 move inwardly, and such that minor bottom flap 62 at least partially overlaps with minor bottom flap 64, minor bottom flap 70 at least partially overlaps with minor bottom flap 72, minor top flap 86 at least partially overlaps with minor top flap 88, and minor top flap 94 at least partially overlaps with minor top flap 96. A third process step 2706 includes coupling overlapping portions 128 of adjacent minor bottom and top flaps to each other. A fourth process step 2708 and a fifth process step 2710 include folding blank 10 about fold lines such that joining tab 36 couples to glue joint panel 20. Minor flap assemblies 118 are then rotated inwardly in sixth process step 2712, and major bottom flaps 54 and 58 are rotated inwardly to couple to minor flap assemblies 118 in a seventh process step 2714 resulting in a formed container 200.

In some embodiments, container 200 is formed with a machine, such as a high-speed container forming machine having a mandrel for forming container 200. For example, at least a portion of container 200, such as reinforcement structure 212, is pre-formed prior to being wrapped around the mandrel. The mandrel includes multiple faces for forming side walls 202, end walls 204, and bottom wall 208 of container 200. At least one face of the mandrel includes a recess sized to receive a corresponding reinforcement structure 212 therein. As such, container 200 may be formed either automatically or semi-automatically with the high-speed container forming machine.

Figure 32:
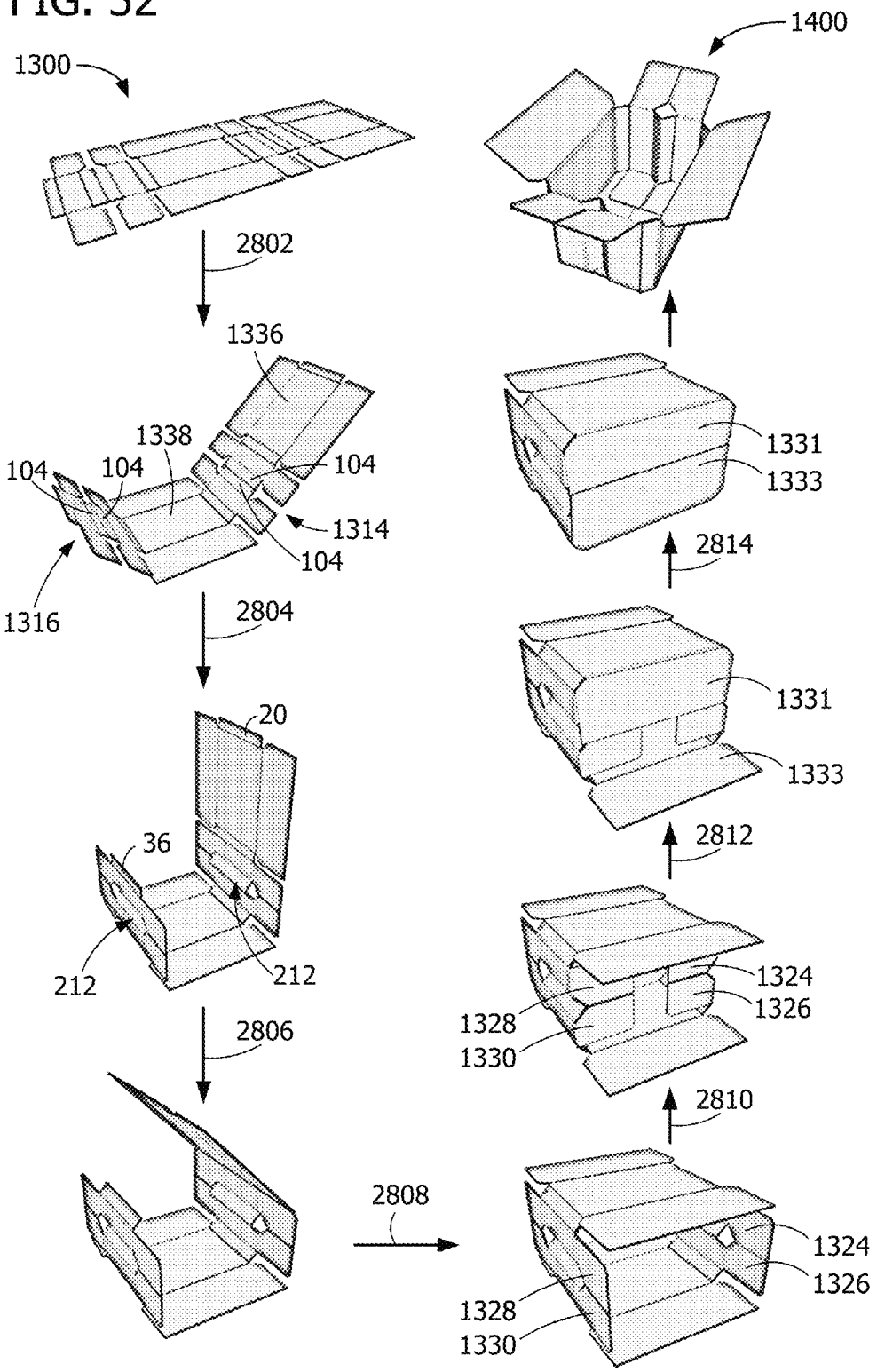
FIG. 32 illustrates an alternative series of process steps for forming the container shown in FIG. 18.

FIG. 32 illustrates an alternative series of process steps for forming container 1400. In the example embodiment, container 1400 is formed from blank 1300 in a first process step 2802 that includes folding blank 1300 about fold lines such that end panels 1314 and 1316 rotate inwardly towards each other. A second process step 2804 includes folding blank 1300 about fold lines such that reinforcement panels 104 move inwardly to form reinforcement structures 212. A third process step 2806 and a fourth process step 2808 includes folding blank 1300 about fold lines such that side panel 1336 rotates inwardly, and such that joining tab 36 couples to glue joint panel 20. Minor bottom flaps 1324, 1326, 1328, and 1330 are then rotated inwardly in a fifth process step 2810, and major bottom flap 1331 is rotated inwardly in a sixth process step 2812. A seventh process step 2814 includes rotating major bottom flap 1333 inwardly for coupling to major bottom flap 1331. In one embodiment, major bottom flap 1333 is glued to major bottom flap 1331 to facilitate maintaining the shape of reinforcement structures 212 when container 1400 is removed from a container forming machine, for example. More specifically, gluing major bottom flaps 1331 and 1333 together facilitates restricting the walls of container 1400 from expanding and thus unfolding reinforcement panels 104.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a container, said blank of sheet material comprising:
   - a bottom flap with a bottom flap first end edge and a bottom flap second end edge;
   - a first coupling flap extending from the bottom flap first end edge;
   - two opposing side panels; and
   - a first end panel and an opposing second end panels, wherein each end panel comprises a plurality of fold lines that define two opposing end panel side edges, a first minor end panel, a second minor end panel, and at least two reinforcement panels positioned between the two end panel side edges,
   - wherein the at least two reinforcement panels are configured to move inwardly towards an interior cavity of the container forming a reinforcement structure when the container is formed; and
   - wherein the first coupling flap is folded upward and coupled to an external surface of one of the first minor end panels when the container is formed.

2. The blank of sheet material in accordance with claim 1 further comprising a second coupling flap extending from the bottom flap second end edge, wherein the second coupling flap is folded upward and coupled to an external surface of an opposing first minor end panel at an opposite end of the container when the container is formed.

3. The blank of sheet material in accordance with claim 2 further comprising a second bottom flap with a bottom flap third end edge and a bottom flap fourth end edge, a third coupling flap extending from the bottom flap third end edge, and a fourth coupling flap extending from the bottom flap fourth end edge.

4. The blank of sheet material in accordance with claim 3, wherein the third and fourth coupling flaps are folded upward and coupled to external surfaces of the opposing second minor end panels when the container is formed.

5. The blank of sheet material in accordance with claim 1, wherein the bottom flap extends from a bottom edge of one of the side panels.

6. The blank of sheet material in accordance with claim 1, wherein the plurality of fold lines are oriented such that the at least two reinforcement panels extend between a top edge and a bottom edge of each end panel.

7. The blank of sheet material in accordance with claim 6, wherein the at least two reinforcement panels are oriented at an oblique angle relative to each other when the reinforcement structure is formed.

8. The blank of sheet material in accordance with claim 6, wherein the at least two reinforcement panels are oriented in face-to-face contact with each other when the reinforcement structure is formed.

9. The blank of sheet material in accordance with claim 1 further comprising a plurality of corner panels, each corner panel positioned between one of the two opposing end panels and one of the two opposing side panels that are adjacent to one another.

10. The blank of sheet material in accordance with claim 3, wherein at least a portion of the first and second bottom flaps overlap with each other when a bottom wall of the container is formed.

11. The blank of sheet material in accordance with claim 1 further comprising
   - a top flap with a top flap first end edge and a top flap second end edge;
   - a first top coupling flap extending from the top flap first end edge;
   - wherein the first top coupling flap is folded downward and coupled to an external surface of one of the first minor end panels when the container is formed.

12. A container formed from a blank of sheet material, said container comprising:
   - two side walls;
   - two end walls, each end wall comprising a plurality of fold lines that define two opposing side edges, a first minor end panel, a second minor end panel, and at least two reinforcement panels positioned between the two side edges, wherein the two end walls are folded along the plurality of fold lines such that the at least two reinforcement panels move inwardly towards an interior cavity of the container forming a reinforcement structure;
   - a first bottom flap having a first end edge and a second end edge; and
   - a first coupling flap extending from the first end edge and folded upward and coupled to an external surface of one of the first minor end panels.

13. The container in accordance with claim 12, wherein the at least two reinforcement panels are oriented at an oblique angle relative to each other.

14. The container in accordance with claim 12, wherein the first bottom flap extends from a bottom edge of a first of the two side walls.

15. The container in accordance with claim 12, further comprising a second bottom flap extending from a bottom edge of a second of the two side walls.

16. The container in accordance with claim 12, wherein the at least two reinforcement panels are oriented in face-to-face contact with each other.

17. The container in accordance with claim 15, wherein at least a portion the first and second bottom flaps overlap with each other.

18. The container in accordance with claim 17, wherein a bottom edge of the at least two reinforcement panels is adjacent to an interior surface of at least one of the first and second bottom flaps.

19. The container in accordance with claim 12 further comprising a plurality of corner panels, each corner panel positioned between one of the two side walls and one of the two end walls that are adjacent to one another.

20. The container in accordance with claim 15, wherein the container has a bottom wall comprising the first bottom flap and the second bottom flap.

21. The container in accordance with claim 20, wherein at least a portion of the first and second bottom flaps overlap with each other and are adhered to each other when the bottom wall of the container is formed.

22. The container in accordance with claim 12 further comprising a first top flap extending from a top edge of a first of the two side wall, and a second top flap extending from a top edge of a second of the two side walls.

23. A method of forming a container from a blank of sheet material, the blank of sheet material including at least one bottom panel, two side panels, two end panels, and two bottom coupling flaps extending from opposing end edges of the bottom panel, wherein each end panel includes a plurality of fold lines that define two opposing side edges, a first minor end panel, a second minor end panel, and at least two reinforcement panels positioned between the two side edges, said method comprising:

folding the two end panels along the plurality of fold lines such that the at least two reinforcement panels move inwardly towards an interior cavity of the container forming a reinforcement structure;

rotating inwardly the bottom panel until the bottom panel is substantially perpendicular to the two end panels; and rotating upwardly each of the two bottom coupling flaps to couple the at bottom panel to the reinforcement structure.

24. The method in accordance with claim 23, wherein folding the two end panels comprises folding the two end panels along the plurality of fold lines such that the at least two reinforcement panels are oriented at an oblique angle relative to each other.

25. The method in accordance with claim 23, wherein folding the two end panels comprises folding the two end panels along the plurality of fold lines such that the at least two reinforcement panels are in face-to-face contact with each other.

26. The container in accordance with claim 23, wherein the bottom panel extends from a bottom edge of one of the side walls.

* * * * *